US007484699B1

(12) United States Patent
Ziegler et al.

(10) Patent No.: US 7,484,699 B1
(45) Date of Patent: Feb. 3, 2009

(54) SUPPORT FOR HUNTING IMPLEMENTS AND ACCESSORIES

(76) Inventors: Rick Lee Ziegler, W6230 Timberlane Rd., Neillsville, WI (US) 54456; Wayne Allen Ziegler, 1490 Cty Rd. G, Rewey, WI (US) 53580

( * ) Notice: Subject to any disclaimer, the term of this patent is extended or adjusted under 35 U.S.C. 154(b) by 281 days.

(21) Appl. No.: 11/184,460

(22) Filed: Jul. 19, 2005

(51) Int. Cl.
*A45F 3/44* (2006.01)

(52) U.S. Cl. ..... 248/156; 248/530

(58) Field of Classification Search ..... 248/156, 248/545, 530, 532, 508, 507, 519, 187.1; 42/94

See application file for complete search history.

(56) References Cited

U.S. PATENT DOCUMENTS

| | | | | |
|---|---|---|---|---|
| 879,052 | A | 2/1908 | Jeranek | |
| 1,112,732 | A | 10/1914 | Uhl | |
| 1,147,890 | A | 7/1915 | Purcell | |
| 1,456,304 | A | 5/1923 | Fritschka | |
| 1,851,779 | A | 3/1932 | Slater | |
| 2,690,211 | A | 9/1954 | Wentz | |
| 3,156,062 | A | 11/1964 | Stevenson et al. | |
| 3,576,084 | A | 4/1971 | Anderson, Jr. | |
| 3,584,820 | A | 6/1971 | Butcher, Sr. | |
| 3,584,821 | A | 6/1971 | Glebe | |
| 3,991,780 | A | 11/1976 | Maroski, Jr. | |
| 4,007,554 | A | 2/1977 | Helmstadter | |
| 4,089,423 | A | 5/1978 | Gorham et al. | |
| 4,481,964 | A | 11/1984 | Minneman | |
| 4,676,021 | A | 6/1987 | Groba | |
| 4,846,140 | A | 7/1989 | DiMartino | |
| 4,854,066 | A | 8/1989 | Canterbury, Sr. | |
| 4,882,869 | A | 11/1989 | Webster | |
| 4,913,391 | A | 4/1990 | Klipp | |
| 4,937,965 | A | 7/1990 | Narvaez | |
| 4,972,619 | A | 11/1990 | Eckert | |
| 5,106,044 | A | 4/1992 | Regard, III et al. | |
| 5,180,874 | A | 1/1993 | Troncoso, Jr | |
| 5,194,678 | A | 3/1993 | Kramer | |
| 5,311,693 | A | 5/1994 | Underwood | |
| 5,481,817 | A | 1/1996 | Parker | |
| 5,619,981 | A | 4/1997 | Breedlove | |
| 5,630,568 | A | 5/1997 | Lubrecht | |
| 5,740,625 | A | 4/1998 | Jenkins | |
| 5,819,720 | A * | 10/1998 | Schubert | 126/41 R |
| 5,913,667 | A | 6/1999 | Smilee | |
| 6,012,439 | A | 1/2000 | Woodruff | |
| 6,029,643 | A | 2/2000 | Golfieri | |

(Continued)

*Primary Examiner*—Ramon O Ramirez
(74) *Attorney, Agent, or Firm*—Loyd W. Bonneville

(57) ABSTRACT

A tubular staff has sections which can be collapsed one into the other down to a very small size. The sections are held together by peripheral clamps snap-tightened by a small lever. There is a ground spike at the bottom of the staff which itself can be removed and stowed within the staff. A firearm cradle can be on top and one end of a small elbowed rod goes either into the top of the staff or into the cradle, if one's there. The rod's other end attaches to a hole in a hunting bow to support it until game arrives. Instead of the elbowed rod, an accessory supporting structure can likewise be set into the staff or cradle. The linkage of the accessory support is a bendable length of ball and socket joints available from certain industrial sources so that the camera angle or telescope can be properly manipulated.

13 Claims, 14 Drawing Sheets

U.S. PATENT DOCUMENTS

| | | | | |
|---|---|---|---|---|
| 6,059,240 | A | 5/2000 | Gorsuch | |
| 6,070,569 | A | 6/2000 | Chalin et al. | |
| 6,205,992 | B1 | 3/2001 | Meeks et al. | |
| 6,254,044 | B1 * | 7/2001 | Lee | 248/177.1 |
| 6,315,256 | B1 | 11/2001 | Tolar | |
| 6,457,685 | B1 | 10/2002 | Taylor | |
| 6,637,171 | B1 * | 10/2003 | Toone | 52/677 |
| 6,749,170 | B1 * | 6/2004 | Rhoads | 248/545 |
| 6,920,834 | B1 * | 7/2005 | Pehta et al. | 108/147.21 |
| 7,047,960 | B2 * | 5/2006 | McCrea | 124/86 |
| 7,080,811 | B2 * | 7/2006 | Thompson | 248/156 |
| 2005/0178935 | A1 * | 8/2005 | Brandes | 248/177.1 |

* cited by examiner 65
72
8
85
84
82
83
81
11
21
24
2
23
22
67
66
13
14
32
3
31
16
15
17
86

SUPPORT FOR HUNTING IMPLEMENTS AND ACCESSORIES

BACKGROUND OF THE INVENTION

1. Field of the Invention

Hunting equipment; sporting goods

2. Description of the Prior Art

Occasionally a descriptive term in this application may be shortened so as to recite only a part rather than the entirety thereof as a matter of convenience or to avoid needless redundancy. In instances in which that is done, it is intended that the same meaning be afforded each manner of expression. Thus, the term cradle emplacement peg (31) might be used in one instance but in another, if meaning is otherwise clear from context, expression might be shortened to emplacement peg (31) or merely peg (31). Any of those forms is intended to convey the same meaning.

The term attach or fasten or any of their forms when so used means that the juncture is of a more or less permanent nature, such as might be accomplished by nails, screws, welds or adhesives. Thus it is stated herein that the preferable connection of the lower portion of a cammed lever enwrapping clamp (81) to the lower of two conjoining segments (13) is one of attachment. A connection in which one object is easily removed from another is described by the word emplace, as where it is stated herein that a portion of the camera connection link (5) may be emplaced within the staff's bushing tunnel (17). A connection in which two objects, although not attached could be separated only with considerable difficulty is referred to herein as one of rigid emplacement. The fastening together of two staff segments (13) by a cammed lever enwrapping clamp (81) is stated herein to be such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that the tight joints of an articulated linkage of accessory support (55) comprise a ball and socket series (56) of rotable hinges, meaning that the latter is in fact the former. The term comprise may also be characterized by what might be considered one-way equivalency, as when it is stated herein that in a given model of the subject matter hereof, three cammed thumb lever clamps (81) at the sectional juncture sites comprise the sectional connecting means (8), meaning that in the given instance, the three clamps (81) are themselves the means (8). This use of the word has a generic sense to it. That is, those clamps (81) will always be means (8); but means (8) might suitably be those members (81) only in one case but, something else in another. However, the word comprise may also be used to describe a feature which is part of the structure, composition or property of a given object. Thus, a preferable bow connection anchor (4) is said to comprise an elbowed, or L-shaped, rod (40). The meaning in the respective cases is clear from context, however. Accordingly, modifying words to clarify which of the three uses is the intended one seem unnecessary.

Terms relating to physical orientation such as top or bottom, upper or lower, upwards or downwards, refer to the positioning of a bow (100), firearm (200), camera (300), spotting scope (400)—a powerful telescopic instrument used to locate game at considerable distance—or any of the components thereof (100, 200, 300, 400) in the manner they (100, 200, 300, 400) would be typically oriented when held in use or supported in readiness; or otherwise, as shown in the drawings. Thus, a segmented (13) tubular staff (71, 72) is spoken of as providing a bottom segment (65) and an upper one (67). The lower portion of a cammed lever enwrapping clamp (81) is said to be configured to tightly retain the upper portion of the lower of two conjoining segments (713) but, under certain circumstances, enwrap the upper of the two (713) loosely. The staff (1) is similarly addressed in terms of its lower (11) and upper (12) ends. So, too, with the extremities of the ground spike (2) which in most other instances are identified by more specific functional names (22, 23, ante). Expressions in terms of longitudinality refer to an object in terms of its longest dimension.

The word co-axial herein is defined to mean with reference to two objects or elements that they share the same longitudinal axis. Thus, in preferred arrangements, the ground spike (2) is said to be co-axial with the staff (1) it (2) is connected to.

By definition herein, the term "transverse" or derivations thereof expressed relative to another structure means generally right angled—as with the configuration of the elbowed rod (40) addressed herein—as distinguished from a precise 90° angle.

The term reeve, or any of various forms thereof, is occasionally employed herein. It is stated, for example, that for interconnection purposes in certain prior art references, an elastic cord was reeved longitudinally through a staff's segments (713).

The terms bow (100) readiness support or firearm (200) readiness support as used herein addresses the aspect in which they (100, 200) are disposed to be quickly and easily picked up for use upon the approach of game. This meaning differentiates from placement in which the hunting implement is ready for immediate shooting—hereinafter identified as Type I modality, ante. The word stow is used to denote placement of a very temporary sort. Thus, to say that a bow (100) or firearm (200) is stowed, as opposed to being stored, would include the notion of emplacing either (100, 200) in readiness support, supra. In a related sense, the expression steadiness, in conjunction with a camera (300) or spotting scope (400), concerns the matter of picture taking or telescopic viewing without the occurrence of undue movement.

In that respect, certain other words may also occasionally be coined herein to simplify discussion by interchanging noun, verb or adjective or by modifying certain words. It takes little imagination to understand, for example, that the coined word turnable, expressed in connection with certain prior art control cranks or handles, derives from the word turn. So too, in the case of interconnective and forwardly. The words rotable and rotability are other examples of coining use denoting an object's capability of being turned without undue impediment within a seat it is disposed in, as opposed to suggesting a rapidly spinning behavior or some other sort of circular motion which might be addressed by the more cumbersome word rotatable. The adjective pivotal also represents rotable disposition. In a similar vein, the expression collapsibility derives from collapse and stowablity from stow. The term interthread and its derivations addresses the coengagement of mated threaded parts, a bolt and nut, for example. The word staff (1, 701) denotes an elongated or post-like structure. The term substitutive interchangeability is meant to express in a given novel scheme that one part or subassembly may be substituted for another for an alternative use, such as by substituting in emplacement an accessory connection link (5) for a bow connection anchor (4).

The term enwrapment, derived from enwrap, describes a physical relationship in which a given object is at least partially cloaked—or more specifically, wrapped up in—a second encompassing one.

Although adjustment schemes comprising set screw and aperture adjustment features (787, 789) are sometimes distinguished for purposes of discussion herein from those employing wing nuts or thumbscrews (788), they (787, 788, 789) are all so similar functionally that their (787, 788, 789) identifiers are occasionally interchanged. It does not appear that doing so is a factor material to patentability.

The word collapsible and its derivations is used herein to indicate an object's capability of being contracted in bulk to improve portability or stowability. As used herein, these words describe the manner in which an object or article comprising tubular elongation (71) comprises sections or segments (13) which slide together to some degree—one into another in what is herein termed rod and sleeve fashion, and that other, in turn, into yet another—so as to reduce total length. The expression telescope and its derivations have often been used in the art in a vague manner and for use in that connection are, therefore, eschewed herein. It is often unclear whether that term is meant to express that a first piece slides into a second one slightly or whether in its entirely; or whether the two pieces are fixed, one within the other, in immobility. It is thought the term may have been borrowed from that describing the sea-faring magnifying piece which so conveniently folded together concentrically. Employing instead with reference to tubular staff (71) configuration the terms derived from the root collapse should, it is hoped, obviate those vagueness difficulties.

Because even the word collapsible could, without more, denote either a partial or total condition or capability, the expression ultra-collapsibility is given to describe the latter case. Thus, an ultra-collapsible tubular staff (71) would permit its reduction to a very small size compared to its extended longitudinality such that, for example, a three-piece length is made to comprise no more than approximately that of one of its sections (13).

By definition herein, a bushing (16), even without more being said, comprises a socket or tunnel (17) and should be considered to comprise either of them (17) interchangeably. Moreover, when the disposition of a flange (14) is said to be circumferential, it is meant that it is the very rim of the tubular object (71) which comprises that configuration. And the term axial is relegated to an object's longitudinal dimension. The word tubular (71) includes elongated hollow structures having any one of a variety of cross sectional configurations. The term curvilinear includes those which are round, oval, ovoid and the like. Similarly, the cross sectional configuration expressed as rectangular (75) includes that which is squared (74).

Although remarks concerning the bow (100) are occasionally compounded as hunting bow (100), the matters therein presented are intended to apply interchangeably to those (100) used for archery, even though not explicitly so expressed.

To the extent any given prior art component comprises part of the subject matter hereof in combination, the same reference number might well have been assigned in each case. Where the number of such adopted components is substantial, however, identical reference number designation might prove confusing. Accordingly, throughout this disclosure, the reference number for any prior art feature or component shared by the subject matter hereof, though identical, is spoken of as having added 700 to it—that is, thereby raising the identifier to the 700s. In the main, this is merely a matter of written disclosure, except for the occasional inclusion of some of them in prior art renderings among the drawings. By way of this convention, then, the prior art reference for the ground spike hereof, "(2)", is said to be "(702)", that for the segmented staff "(13)", as "(713)", and so on.

Hunting stands, of course, sometimes comprised elaborate constructions wherein the framework itself provided more than enough support for bow (100), firearm (200), camera (300) or spotting scope (400). For example, U.S. Pat. No. 6,012,439 issued to Woodruff featured a seating structure allowing for emplacement of a bow connection anchor (704) which, together with the bow (100), could be lifted for use in Type IV modality, ante. U.S. Pat. No. 6,547,685 B1 issued to Taylor comprised a rack-like construction against which either a bow (100) or firearm (200) could be lain and extracted for use in that same way. As we shall see, however, stable as they might be for supporting purposes, the provision of cumbersome structures of that sort is not among the objectives hereof.

In considering an assembly for readiness bow (100) support, or photographic steadiness for a camera (300) or spotting scope (400), it is instructive to examine and, perhaps, borrow some of the sisterhood features of firearm (200) aiming supports.

The forcing of a pointed ground spike (702) into the underlying soil (500), for example, is extensively addressed in U.S. Pat. No. 5,740,625 issued to Jenkins and references reported therein. The feature (702) enabling that undertaking was often adopted for reasons of reliability and simplicity whether or not it (702) was embellished with a foot thruster (725). One of the versions of the cited Narvaez reference, ante, comprised a ground spike (702) wisely inverted for stowage within a segmented (713) tubular staff (771).

In that connection, reliance upon a monopod staff (701) whose bulk might be of take-apart configuration or otherwise collapsible for purposes of stowage and portability echoes from the past with resonance at least equally respectable to that of the ground spike (702), foot thruster (725) and other adoptive features. The Jenkins patent and many of those cited there were no exceptions to that oft-followed trend toward convenient collapsibility.

A Narvaez model, ante, for example, featured among the Jenkins references, employed either a snap-fit spring loaded beach umbrella type connector or an interthreading ring for height adjustment. The assemblies of Jeranek, Canterbury, Sr., Fritschka, Parker and Helmstadter comprised set screw (787) adjustment connectors. Uhl's collapsible sections (713) were unitized by a twist-together series of slot and pin fittings.

In Kramer and Underwood, the segments (713) were interconnected by an elastic cord reeved through them (713) longitudinally. Webster, ante, presented external spring laden friction clamps for interconnection. Groba's connector used a similar frictional principle and, the tubular (771) sections (713) were simply, but cleverly, configured with flanged connective ends (714) specifically comprising mutually engaging turned annular beads—a simple technique well worth adopting—to keep the pieces from merely falling apart from each other, ante.

The most pertinent Jenkins references comprise U.S. Pat. No. 879,052 issued to Jeranek; U.S. Pat. No. 1,112,732 issued to Uhl; U.S. Pat. No. 1,147,890 issued to Purcell; U.S. Pat. No. 1,456,304 issued to Fritschka; U.S. Pat. No. 2,690,211 issued to Wentz; U.S. Pat. No. 3,156,062 issued to Stevenson, et al.; U.S. Pat. No. 3,584,821 issued to Glebe; U.S. Pat. No. 3,576,084 issued to Anderson, Jr.; U.S. Pat. No. 4,007,554 issued to Helmstadter; U.S. Pat. No. 4,089,423 issued to Gorham; U.S. Pat. No. 4,481,964 issued to Minneman; U.S.

Pat. No. 4,676,021 issued to Groba; U.S. Pat. No. 4,854,066 issued to Canterbury, Sr.; U.S. Pat. No. 4,882,869 issued to Webster; U.S. Pat. No. 4,913,391 issued to Klipp; U.S. Pat. No. 4,937,965 issued to Narvaez; U.S. Pat. No. 4,972,619 issued to Eckert; U.S. Pat. No. 5,180,874 issued to Troncoso, Jr.; U.S. Pat. No. 5,194,678 issued to Kramer; U.S. Pat. No. 5,311,693 issued to Underwood; U.S. Pat. No. 5,481,817 issued to Parker.

There was, of course, a line of development belonging solely to the bow (100), ostensibly having nothing to do with any firearm (200) support. A suitable prop for a bow (100) permitted putting it (100) aside in readiness so that the hunter remained unencumbered by its (100) awkward, cumbersome bulk while awaiting the arrival of game. Under most practical circumstances, hunting bows (100), particularly the modern ones (100), are too heavy to be actively attended in a position poised for the shot. From what we see in the art, we may consider arrangements for the bow's (100) use in relation to its (100) standard or support as one of four sorts.

A Type I modality is one in which the bow's (100) connection to the support is usually one either of attachment or rigid emplacement, as those terms are defined herein, supra, as might be the case where the arrow is merely discharged from a ready-to-shoot posture or, at least, something closely approximating it. While arrangements of that sort have been more appropriate for firearm (200) use, in the few instances in which they were suggested, they had to have compromised bow (100) use or convenience in portability. There, readiness stowability would have been provided at the expense of shooting accuracy and convenience.

A Type II scheme permits picking up the bow (100) from its (100) moorings but only after undertaking significant manipulative efforts—unfettering well secured connections and the like. That arrangement, unfortunately, has entailed an unwanted time lapse for game to escape while getting set for shooting and often has not been as quiet in operation as desired.

In Type III, the bow (100) could be picked up for use but only with all or a significant portion of the standard along with it (100). It was understandably thought better to bear a little extra weight and bulk while shooting than frighten away the game by unsnapping clamps or binders.

A Type IV construction involves merely the picking up of an emplaced bow (100) such that it (100) is entirely free of any part of the support or at most, carries along a very small portion of it. Those have been the most preferred of the lot. Even so, the looseness of their connections often subjected them to risk of unsteadiness on difficult terrain or perhaps to dislodgment by too stiff a breeze.

But means of readiness stowability is but one criteria for comparison. Whether for firearm (200) or bow (100) operation, portability has always been-a significant factor. Any hunting kit which can be collapsed within itself—"telescoped", as some vaguely say for sectional constructions (713)—will invariably have an edge over one wherein that capability is absent. Packing and carting a fully extended staff (701) in a rack atop an automobile or within its trunk, while plausible, is too cumbersome an undertaking for the likes of most hunters. A spiked (702) assembly makes the task just that much more difficult.

Important patents following the bow (100) support line were U.S. Pat. No. 5,106,044 issued to Regard III; U.S. Pat. No. 3,991,780 issued to Maroski, Jr.; U.S. Pat. No. 1,851,779 issued to Slater; U.S. Pat. No. 3,584,820 issued to Butcher, Sr.; U.S. Pat. No. 5,619,981 issued to Breedlove; and U.S. Pat. No. 4,846,140 issued to DiMartino.

The Regard III assembly comprised three-point support, the contact with the ground (500) by the bottom tip of the bow itself (100) counting for one of them. Whatever objections some have voiced concerning ground (500) contact by the bow (100) because of imagined potential for damage—say, to a bowstring reel usually disposed at that low extremity in the modern hunting implements—the additional stability afforded thereby without the inclusion of additional apparatus evinces cleverness in design. The other two support sites were provided by a pair of flexible leg-like extensions which could be gathered against the bow (100) and snapped in place when the bow (100) was picked up for use. By reason of the manipulation required, the assembly demonstrated Type II configuration; but by reason of the keeping together of the entire assembly—however compacted and light in weight-indicated also that of Type III. The grounded (500) bow (100) and bendable legs of the assembly primarily of focus in U.S. Pat. No. 6,205,992 B1 issued to Meeks, et. al. appear to have wisely followed the Regard III lead.

The Maroski, Jr. assembly featured, among other things, two-point support upon a two-piece (713) ground spiked (702) tubular staff (771) adjustable in height by means of a wing nut (788) and a series of spaced holes (789) therein (771). The assembly illustrated a Type IV configuration in that the bow's (100) curvature permitted it (100) to rest delicately against two supportive sites disposed along the length of a ground-spiked (702) staff (701). Because of the looseness of its (100) stowage, it is doubtful the bow (100) would have endured a strong wind. For that contingency, the assembly also comprised an attached rope which might have been tied to a tree branch or other anchoring site (550).

Slater also provided Type IV configuration wherein the bow (100) rested horizontally upon a shelf borne by a ground spiked (702) staff (701). While there were no impediments to its (100) removal for shooting—as with Maroski, Jr.—the arrangement must have lacked stability in the face of the elements.

Butcher, Sr., featured three-point retention upon a staff (701) vaguely suggested to be adjustable in height by a set screw (787) and collar combination. Removal of the bow (100) required working it (100) out of a ring-like retention yoke, thereby evincing the less preferred Type II configuration. One of the models comprised a ground spike (702).

The DiMartino ground spiked (702) assembly comprised for a connection mechanism a turnable handle similar to that used to open and close a tool-bench vise. The necessity for manipulation upon release portrayed Type II modality.

Although the "preferred embodiment" mentioned in Breedlove is touted to permit height adjustment by reason of "telescopic" and "lockable" features, specific details are wanting both in his drawings and written disclosure. The 22 page patent focuses primarily upon a pivoting elbow to which a longitudinal extension doubles for use either as a vertically oriented bow (100) support or a horizontally projecting stabilizing rod (402). Practicality may have, therefore, dictated some obtuseness concerning height adjustment and collapsible capabilities. After all, several unremarkable alternative tube (771) clamping mechanisms then known included the set screw (787) or wing nut (788), with or without threaded apertures (789); the snap-fit spring loaded button and receptor hole configuration found in lawn and beach umbrellas; and a threaded ring connection vaguely suggested in the first of the drawings. The model presented sans ground spike (702)—that almost exclusively addressed therein—surprisingly, but necessarily, portrays Type III configuration wherein the bulk thereof is removed from an anchored socket for shooting. In a variation comprising the ground spike (702), however, the assembly remains fixed for use in Type I modality. Aside from that, however, the patent admirably addresses the oft-overlooked difficulty of want of sufficient space between the forwardly displaced curvature of the bow (100) and the support, recognizing that the limbs of modern bows (100) are formed with sufficient convexity to interfere with most standards unless some provision is taken to address the matter. Certainly, any support which attaches to a bow (100) should do so at a site thereon (100) which provides the required clearance; or at least provide a stabilizing rod (402) or similar structure which allows for the clearance. Because a bow's anchoring well (401) provides such a convenient connection site for the support, its (401) optimal placement constitutes an important matter to acknowledge in bow (100) manufacture.

U.S. Pat. No. 6,029,643 B1 issued to Golfieri illustrated Type IV modality wherein a projection from an aimed and handheld bow (100) was disposed to merely rest upon a set screw (87) and threaded aperture (89) height adjusting arrangement. The arrangement there, however, merely assisted the shooting operation, providing no capability at all for independent readiness stowability.

In U.S. Pat. No. 6,059,240 issued to Gorsuch, a Type IV support system wherein the bow (100) was merely lifted from a hanger for use, featured a length adjusting scheme similar to those discussed supra for lawn umbrellas and even then, only for horizontal longitudinality. Additionally, the tubular configuration (771) was of squared (774) rather than cylindrical (772) cross section.

U.S. Pat. No. 6,070,569 issued to Chalin, et. al., a Type IV system also, boasts a "unique" system for collapsible tubular interconnectibility, employing what is described as an "internal locking mechanism". However, because of drawing conventions undertaken which are non-traditional to patent presentation, specific details appear to be vague or wanting altogether. A series of off-center circular renderings suggest a circularly bent leaf spring camming operation. Those may have been intended to reflect in combination known prior art mechanisms rather than any construction of novelty. A system of cylindrical tube (771) staff segment (713) interconnection by means of the joining feature suggested would, indeed, be useful. Although the use of the term "telescopic" and the illustrated diameter of respective segments (713) suggest the capacity to slide one thereof (713) into another (713), the extent to which that is possible is not explained. Thus, while it would be theoretically possible for the assembly to comprise what is defined herein as ultra-collapsibility, that is not entirely clear.

Reliance upon the historical firearm (200) supports, supra, provides yet another useful avenue of pursuit. Where they are concerned, the cradle (703) has been one of their near-essential ingredients. A reference encompassing not only that (703) but other features pertinent hereto is U.S. Pat. No. 5,913,667 issued to Smilee. That assembly illustrates three-point support for a rifle (200) and comprises a ground spike (702), foot thruster (725), two in-line cradles (703) and a two-section (713) tubular staff (771) comprising set screw (788) and aligned threaded receptor holes (789). Because of the respective segment (713) lengths, the arrangement does not qualify as ultra-collapsible but does permit partial contraction. The unit is constructed to allow respective parts thereof to pivot together for stowage.

The cradle (703) may also be found in abundance under the Jenkins references, supra. It (703) is part of the Narvaez assembly, for example, wherein azimuth settings may be changed by turning a handle and those for height, by manually effected pin and aperture connections. That (703) provided by Jeranek is suggested as having rotable emplacement. Glebe provided a fold-up version (703) retained in place upon the staff (701) by acentric principles. In Purcell, the firearm (200) was cradled merely upon a hand-held coil spring (703). The cradle (703) in Webster was well designed in allowing for rotable emplacement of an accessory connection link (705) within it (703).

The modern bow (100), however, is generally provided with cradle-like configuration at the site thereon (100) the arrow is emplaced for release and flight. When using even the more traditional one (100), however, the arrow has been steadied merely upon the operator's grasping fist. One would not, therefore, expect to find a bow (100) supporting assembly dedicated to dual use—bow (100) stowage under some circumstances and firearm (200) aiming support under others. Absent special arrangements, a firearm cradle (703) would seem to have just gotten in the way.

Along the way, it also became apparent that once an acceptable staff (701) had been devised, it (701) might, if appropriately configured, double also as an accessory connection link (705). A camera (300) and a spotting scope (400) are each generally configured with a threaded well (301) at their (300, 400) respective undersides within which various tripods or other supportive standards may interthread for attachment. Thus, the uppermost portion of Webster's segmented staff (713), supra, provided an accessory connection link (705) comprising the usual threaded accessory connecting sector (758) at its accessory connecting end (751) and a rotable emplacement end (752) for its (705) connection to the staff (701).

The challenge in accessory (300, 400) supporting arrangements is to provide some means of maneuverability to the support by which the accessory's (300) angular position might be selectively controlled. These are identified herein in the generic sense as positional adjustment axis support means (53, 753). More specifically, for example, accessory supports at prior art sometimes comprised a protractor-like arrangement (54) for adjustment in a vertical plane. Ideally, easily manipulated accessory (300) adjustment in any of the three dimensions is, by far, that most preferred. There are jointed bendable solid composition linkages used for certain industrial purposes—such as to control the jet of a coolant for cutting tools, ante—which provide the sought-after flexibility. The legs in one embodiment of the Meeks, et. al. reference, supra, suggest another, although its specific configuration is not clearly disclosed therein.

U.S. Pat. No. 6,315,256 B1 issued to Tolar functionally coupled a dual-function firearm cradle (703) with a horizontally rotable camera (300) support. More interestingly, for connection to a rod-like extension, cammed peripheral clamping means—somewhat resembling an oil filter wrench—are shown which potentially have application to a segmented tubular staff (713).

As one will observe supra, the holding together of a tubular staff's (771) sectional components (713) has always presented a challenge. There has emerged from the art, however a mechanism—available in various sizes—capable of tightly housing the ends of the respective tubular (771) segments (713) in opposition, holding them (713) firmly in place end-to-end, and then providing a situs—a cammed clamp sector (82) comprising for the camming action a clearance opening (84)—a window within which a hinged (83) cammed lever clamp (81) is made to bear down peripherally upon the end of a respective one of them (713). The clamp (81) is disposed at each interconnective junction between segments (713).

Thus, two tubular segments (713) can be longitudinally fixed together. The interior of the clamp (81) is configured in size to accommodate the respective diameters of the segments (713). The lower portion of the clamp (81) is configured to enwrap the upper portion of the lower conjoining segment (713) snugly, preferably by means of attachment. The upper portion of the clamp (81) is configured to loosely enwrap the upper segment (713) when camming action is not applied but retain it (713) snugly when it is. Where segments (713) comprise successively larger diameters from top to bottom such that the first at the top slide into a second and the second into a third and so on, to effect a proper fit, the interior of the upper end of each clamp (81) is accordingly made smaller than the interior of the lower end.

Without further undertaking, when a clamp (81 is loosened, there is nothing to impede or restrict interconnecting lengths (13, 713) from merely sliding apart from one another. The industry deals with this matter in various ways-factoring detents, small catch-knobs or providing other configurational solutions for respective parts. A satisfactory technique, which one may observe upon inspection, is to configure the inside of the clamp (81) with a stop and then merely form at the lower end of the upper of two segments (13, 713) a rim or circumferential widening—or what is designated herein a sectional flare or flange (714). As it turns out, the inevitable inner diameter ridge resulting from hollowing out a portion of the clamp (81) in preparation as a seating site for the tube's (771) end is suitable for double service as the stop. By way of definition herein, a cammed lever enwrapping clamp (81) inherently and necessarily comprises a stop. The flanged lip (14) is made small enough to permit forcing the segments (13, 713) together. Yet, it (14) is made large enough to provide substantial friction between them (13, 713) once joined. With this fairly close tolerance fit, it is observed that a forceful tug is required to pull the flanged end (14) of one segment (13, 713) out of the other (13, 713).

To cast the achieved situation in more formal terms, it is sufficient to say that it is feasible to arrange a plurality of interconnective tubular staff segments (13, 713), configured in progressive rod and sleeve fashion wherein the segments (13, 713) may be co-axially collapsed within one another (13, 713), narrowest to widest, the lowest comprising the widest, or may conversely be co-axially extended from within one another (13, 713), widest to narrowest, each of two conjoining segments (13, 713) being interconnected by a cammed lever enwrapping clamp (81); and the lower connective end of each conjoining segment (13, 713) comprising a rim flanged (14) sufficiently to impede its (13, 713) upward withdrawal beyond the clamp's (81) stop. Operation of the camming lever—a thumb lever (85) in a clamp (81) comprising one (85) or the handheld lever in a handgrip assembly (86), ante—by causing the cam to impose impingement prevents disconnection of the conjoined segments (13, 713). Release of the thumb lever (85) or that of a handgrip assembly (86), ante, permits extension by withdrawal of one segment (13, 713) from another at least to the stopping point for the flange (14).

The segments (13, 713) may, as suggested supra, be pulled out in extension however far desired to achieve a particular staff (1) length—that is, all of the way out or instead, to any intermediate point. Once so adjusted, they (13, 713) are again held firmly in place by what is characterized herein as sectional connecting means (708), of which the cammed lever enwrapping clamp (81) discussed supra is but one example, albeit the most preferred one. While such means (708) may, for example, comprise snap-fit arrangements, such as provided for a beach umbrella, those are relatively expensive to make and their springs subject to tension wear. The means (708) may also alternatively comprise an assembly clamp of the set screw (87) or thumb screw (88) variety with threaded apertures (89), supra, but those are vexed by difficulties of their (87, 88) own. The cammed thumb lever enwrapping clamp (81), supra, disposed at each connection point between segments (13, 713) is preferred, particularly one comprising a thumb lever (85).

The cammed lever enwrapping clamp (81) is known in two forms. The first is a handgrip cam assembly (86), wherein the lever operated to lower the cam comprises a handgrip type handle which extends longitudinally along the segmented staff (13, 713). The hinge (83) is disposed transversely to the staff's (13, 713) longitudinality. The second and more preferred form is the more compact variety comprising a clamp thumb lever (85) and in those, the cam hinge (83) is disposed parallel to the staff's (13, 713) longitudinality.

In recognition of the instability of the upwardly projected modern bow (100) when poised for shooting, allowances have been made in the art to deal with its (100) weight and configuration. Specifically, a stabilizing rod (402) has been attached in front and configured to serve as a counterweight (404). Connection has been made by means of interthreading a bolt-like extension upon the rod (402) with a threaded cavity (403) in the bow itself (100). However, the counterweight (404) has never been considered absolutely essential to the bow's (100) use and it was quickly recognized that the cavity (403) provided a suitable connection situs also for a readiness support assembly.

In another vein wherein no ground spike (702) was employed, U.S. patent issued to Lubrecht devised an appendage comprising a bolt-like threaded rod (792) transversely attached to the bow's disconnected stabilizing rod (402) so that it (792) could be cranked, using the stabilizing rod (402) as the handle, to screw it (792) into a tree or other supporting structure (550). Afterwards, the stabilizing rod (402) was interthreaded with the bow's stabilizing rod threaded cavity (403) to provide the bow a horizontally (709) anchored site comprising of stowage in Type II modality.

It is tempting to wonder whether most of the offered devices were really new at all with respect to their forerunners. Certainly, there seems to have been an overabundance of game awaiting or game readiness gadgetry. Some credit, perhaps, derived from the hunting traditions so long an honored part of our history. But it was probably more the manner in which the parts were fitted and held together than the assembled structure itself which conferred patentable novelty upon those numerous variations on a common theme. And, undoubtedly, there still remains plenty of room for more. Surely, hunting will always endure and the provision of innovative tools to undertake it, always be welcomed.

It would also be useful if a readiness stowage assembly were provided which not only dependably accommodates the bow (100), the firearm (200), the camera (300), the spotting scope (400) or any other suitable accessory by substitutive interchange, but which permits the bow (100) to be picked up immediately from its stowage site and operated without the encumbrance of additional weight—that is, in Type IV modality. To be sure, the longstanding insistence upon firearm (200) support functionality, if only for its (200) own sake, should not be disregarded. Beyond that, however, the provision of rotability for both bow (100) and firearm (200) readiness would be of great value in orienting the assembly toward a point from which game might be expected to emerge. Camera (300) steadiness for picture taking and spotting scope (400) steadiness for telescopic viewing, on the other hand, without having to rely upon a tripod arrangement, should also be provided for in the same assembly. By the same token, a suitable flexible view framing means should be included which retains the angular position to which it is brought—something superior to the pivotable plane, or protractor-like structures (54) so common to picture taking and scope viewing supports of the past. Safety from spike (702) impalement injury and unwanted damage should be a factor. Most of all, the entire assembly should comprise ultra-collapsibility—say, for example, a ground spiked (702) unit capable of collapsing down to a pocket sized pack less than a third its extended length.

In its own context, the historical development has done well in addressing deep-seated needs and objectives related to readiness stowability support use. It is now time, however, to combine the fruits of those past efforts in a more innovative way than has thus far been undertaken to address needs and objectives emanating in part even from them.

SUMMARY OF THE INVENTION

The invention comprises in combination a bow (100) and firearm (200) game readiness support as well as a camera (300) and spotting scope (400) steadiness support for photographic use or telescopic viewing in which the staff (1), if tubular (71) as preferred, is subdivided into sections, or segments (13), which may be collapsed so that one segment (13) fits within another (13), which in turn fits into still another (13), and so on for the number of segments (13) involved. Whether collapsed or extended, however, the segments (13) are held together in rigid emplacement by cammed lever enwrapping clamps, either of the thumb lever or handgrip variety (81, 86, respectively).

In the preferred tubular staff (71), a removable ground spike (2) protruding from its lower end (11) may be reversed and fitted therein (71) for stowage permitting the assembly to be disposed an ultra-collapsible state.

A cradle (3), optionally disposed atop the staff, serves as a firearm (200) rest for gun hunting.

A short right angled—or "L" shaped—bow connection anchoring rod (4) is emplaced within a tunnel or socket (17, 18, 31) rotatably disposed either within the bushing (16) of a tubular staff (71); the staff itself (1), if of solid construction (61); or a cradle (3), if present. An extending leg (42) of the bow connection anchor (4) is interthreaded into a receptor tunnel (401) disposed in the bow (200), thereby anchoring the bow (200) in an upright position for game readiness stowage.

The accessory steadiness support functionality referred to supra is provided by emplacing into the staff (1), a bushing therein (16) or a cradle (3), if present, an easily manipulated accessory connection link (5). Moreover, a subassembly comprising an anchoring dowel (91) and threaded anchoring rod (92)—such as a lag bolt—may be used to anchor the assembly horizontally (9) into a tree (550).

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention. A single planular cross-section portrays objects as they appear in a given cross-sectional plane disposed within the object's interior so that portions thereof situated behind or farther back from the plane are not shown. A medial cross-section is a single planular cross-section disposed at the object's midpoint.

FIG. 12 illustrates the clamping site for the extended ground spike (2), FIG. 13 the site for juncture of the mid-segment (66) and upper segment (67) and FIG. 15, that for the lower and mid-segments (65, 66, respectively).

FIG. 14 comprises the cradle (3) and its usual connection arrangement wherein its emplacement peg (31) is seated within the staff's bushing tunnel (17).

FIG. 16 depicts a handgrip cam assembly (86) slightly less preferred to the thumb lever variety (81) because of the size of its (86) handle. Visible in three of these—FIGS. 13, 15 and 16—are the sectional flanges (14) which provide limiting stops for the segments (65-67) even when unclamped.

FIG. 25; oval (79),

FIG. 26; square (74),

FIG. 27; rectangular (75),

FIG. 28; hexagonal (77),

FIG. 29; and triangular (76),

FIG. 30. As explained herein, the first two configurations fall within the meaning of the term "curvilinear" (78) herein; the others, in the term "polygonal" (73).

FIG. 32 specifically addresses just the anchoring dowel (91) portion of the subassembly which fits within the lower segment (65) in substitution for the ground spike (2). A gripping pad (93) enwraps the dowel (91) as an aid to twisting in the threaded rod (92).

DESCRIPTION OF THE PREFERRED EMBODIMENT

Figure 1:
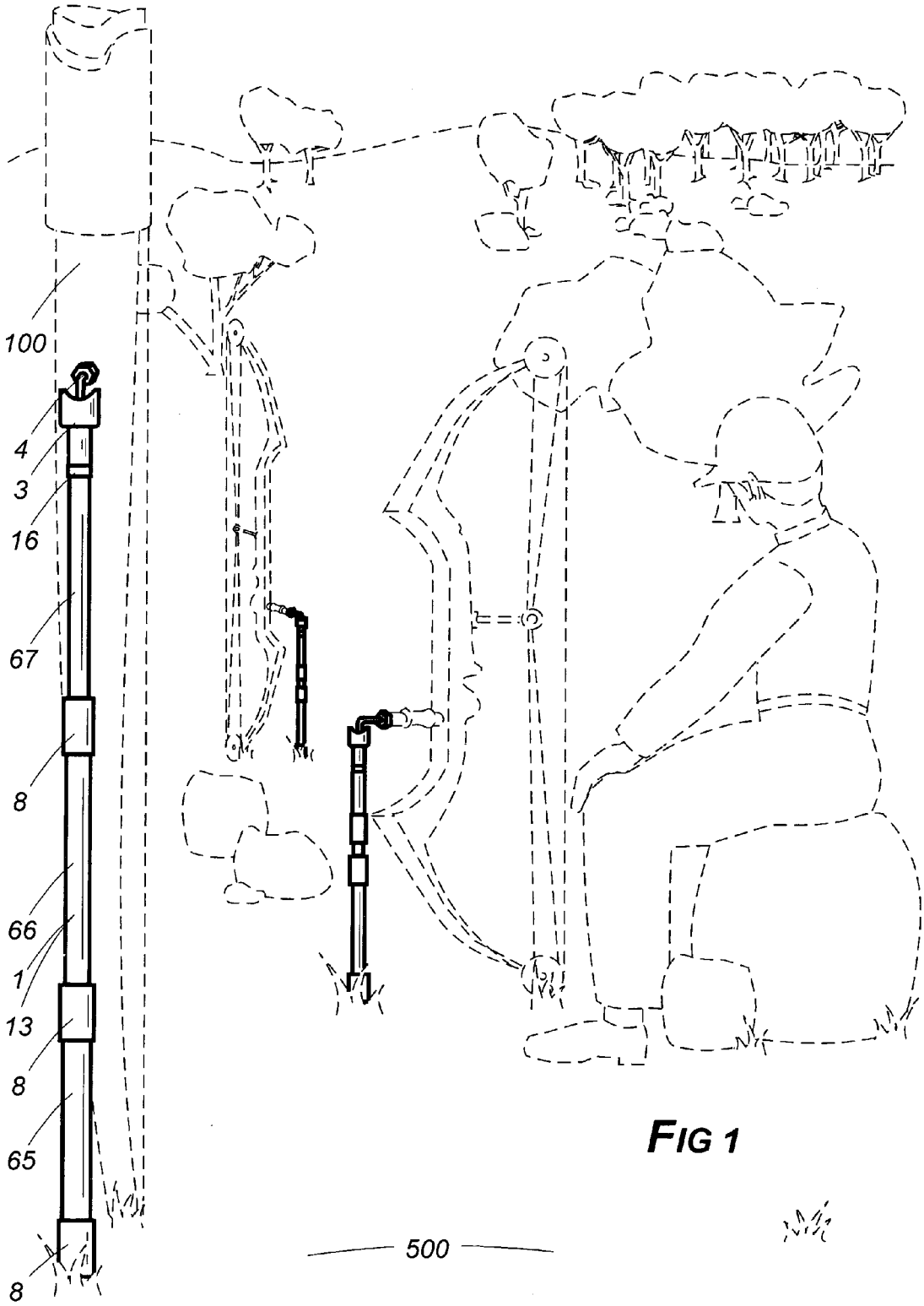
FIG. 1 presents a setting in which three of the assemblies are set up with their spikes (2) anchored in the ground (500) and their bow connection anchors (4) connected to respective hunting bows (100) while a hunter awaits the arrival of two others. The staffs (1) have been partially collapsed for the two compound bows (100) situated to the right. That (1) in the left foreground, however, is shown fully extended to accommodate for the greater length of the traditional bow (100) it (1) supports, shown in partial cut-away view.
Figure 2:
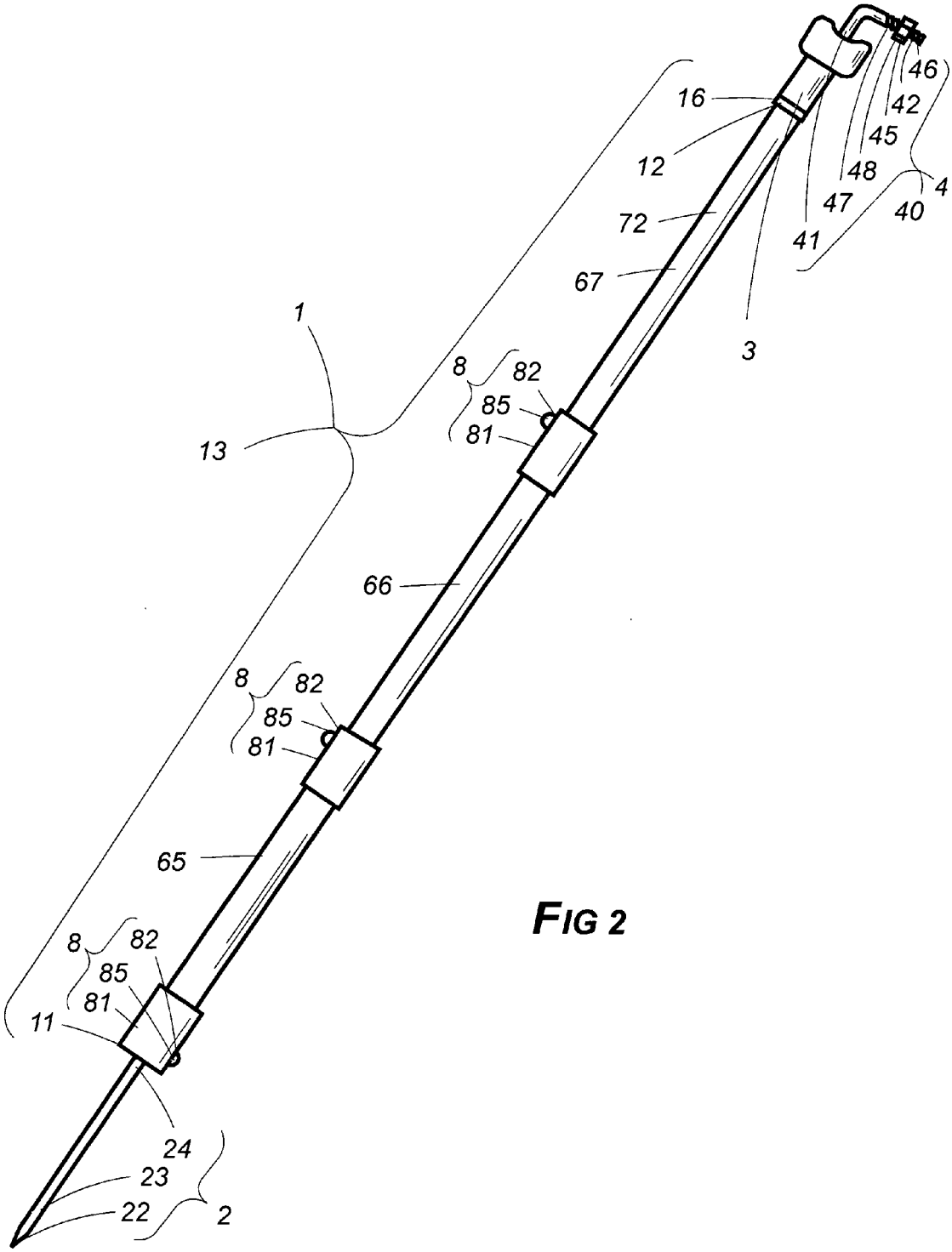
FIGS. 2 and 3 portray the preferred segmented (13) cylindrical (72) model of the invention in extended mode, the latter illustration comprising a longitudinal medial cross-sectional view. The staff (1) together with its bushing (16), the spike (2), the cradle (3) and the bow connection anchor (4) are all evident. Three cammed thumb lever clamps (81) at the sectional juncture sites comprise the sectional connecting means (8). ½
Figure 3:
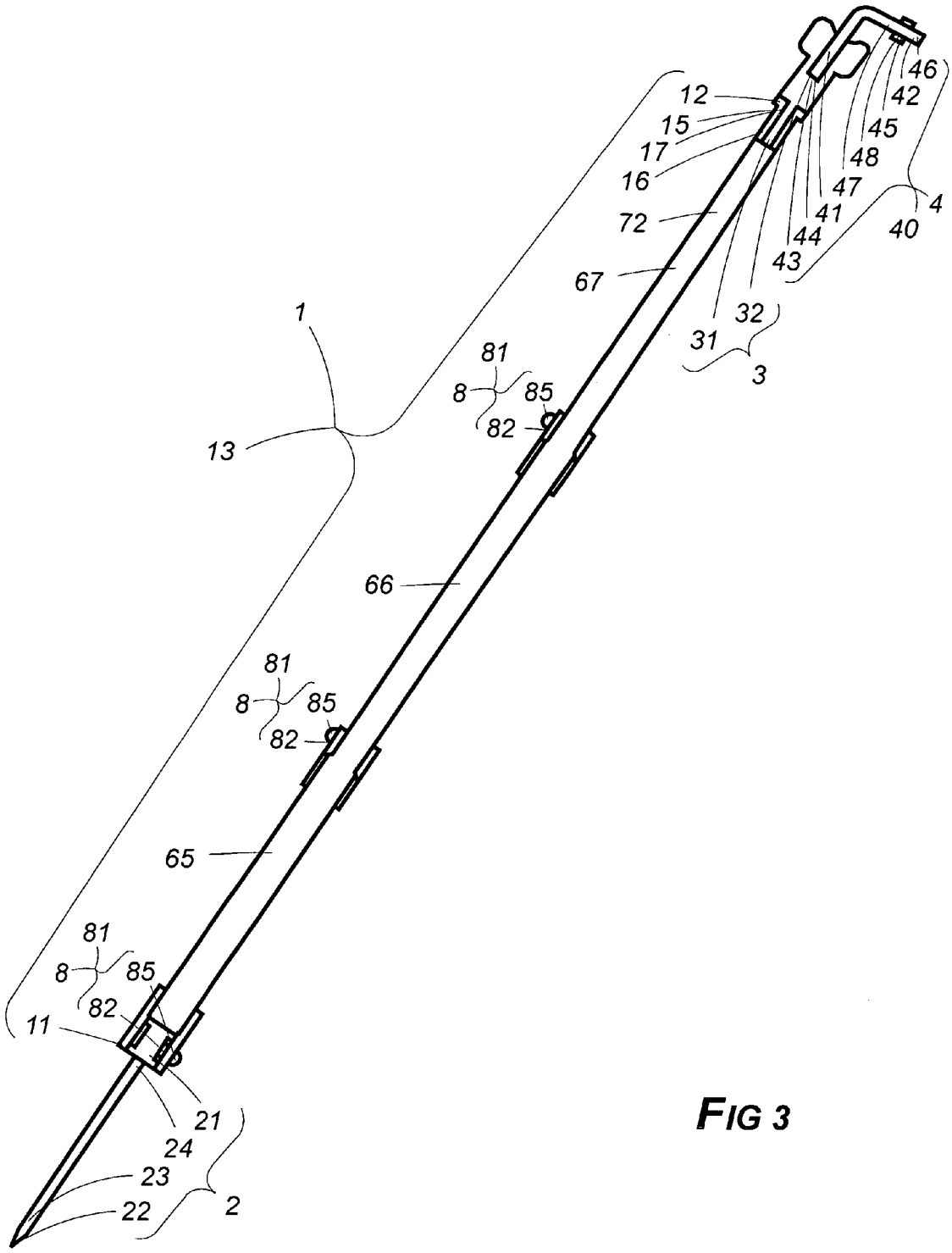
Figure 4:
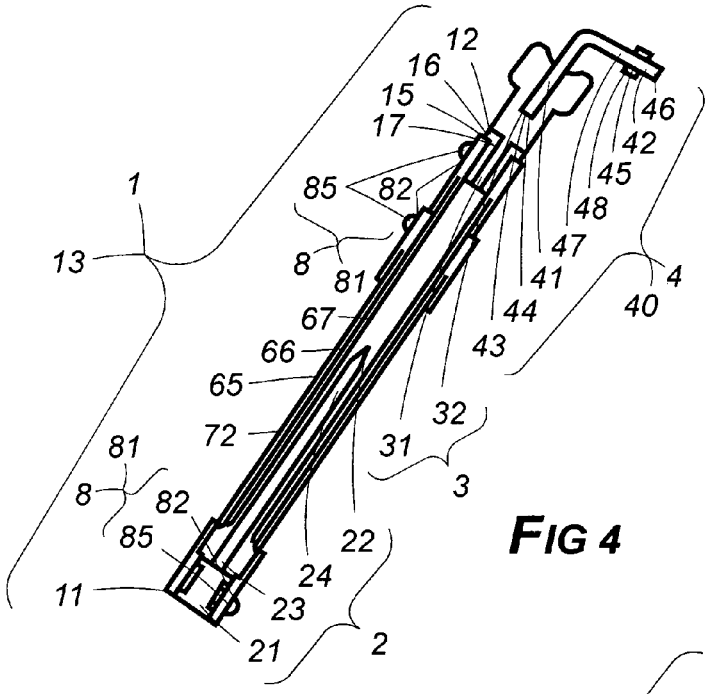
FIGS. 4 and 5 illustrate the same embodiment (13, 72) in compacted mode, the latter drawing similarly in longitudinal medial cross-sectional presentation. The ground spike's (2) clearly shown inversion within the bottom segment (65), illustrating one factor by which an extended assembly 33 inch in length—even without the inclusion of emplacement features atop—is capable of reduction, in their absence, to a pocket-size less than 11 inches.
Figure 5:
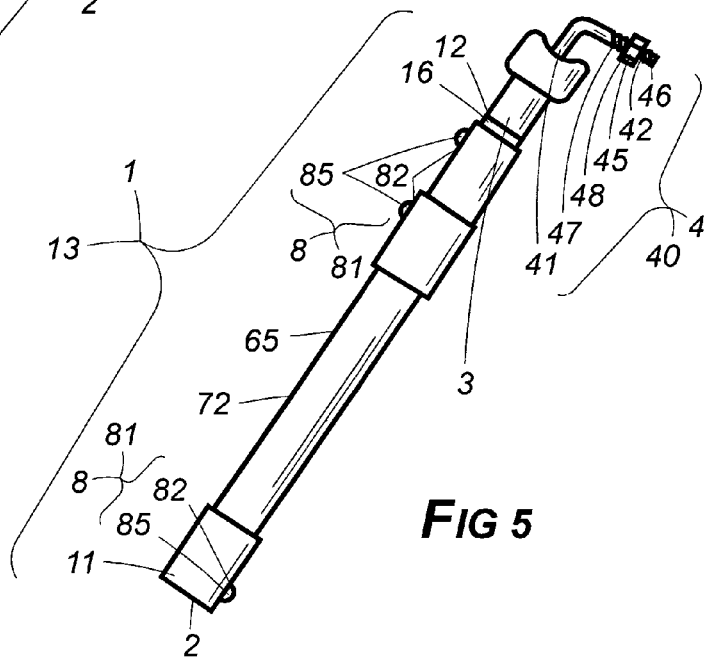
Figure 6:
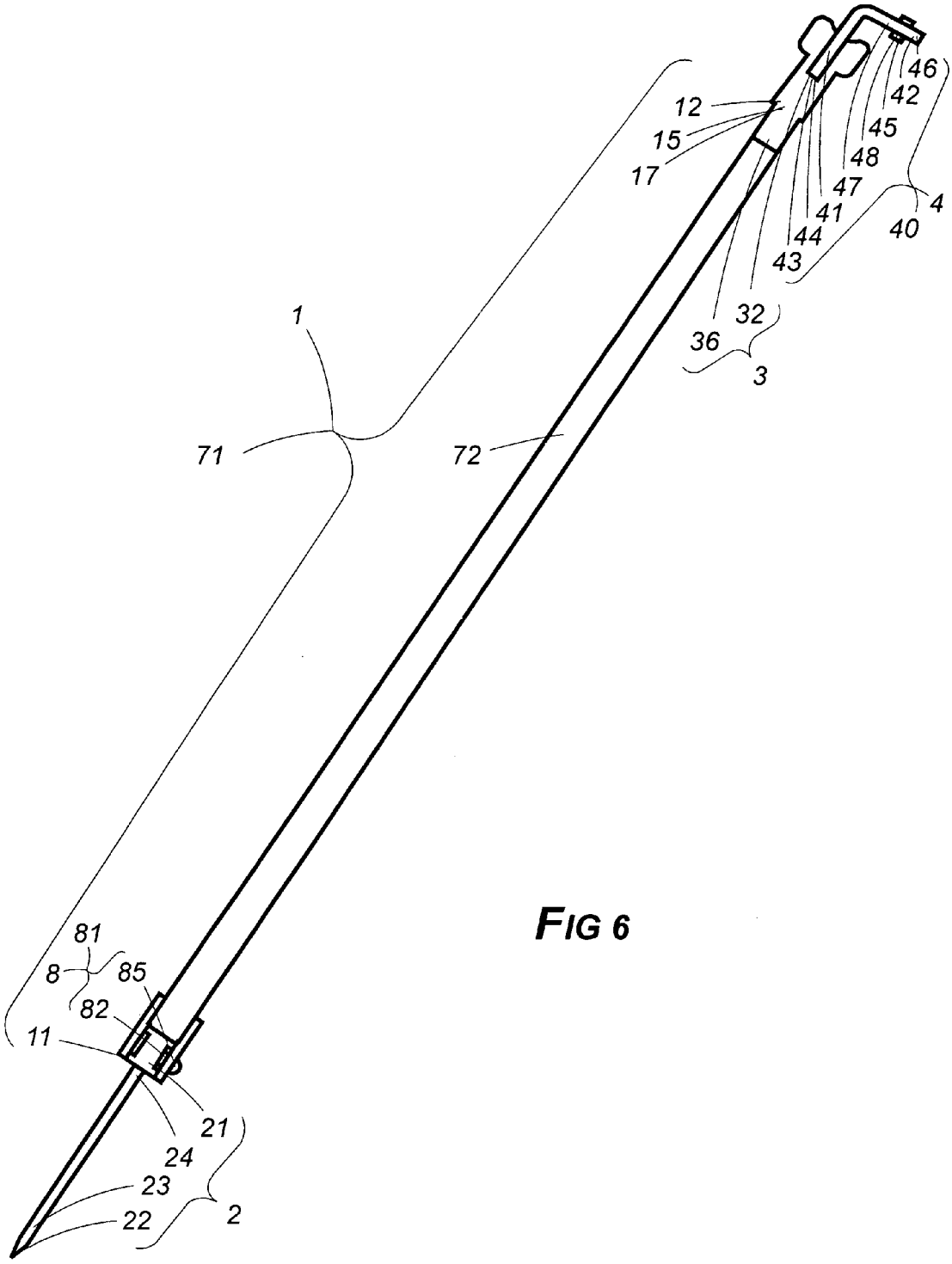
FIG. 6 comprises a longitudinal medial cross-section of a non-segmented cylindrical (72) version in which only one cammed thumb lever clamp (81) is required—that (81) fastening the spike (2) in place and permitting its (2) inverted stowage.
Figures 7, 8:
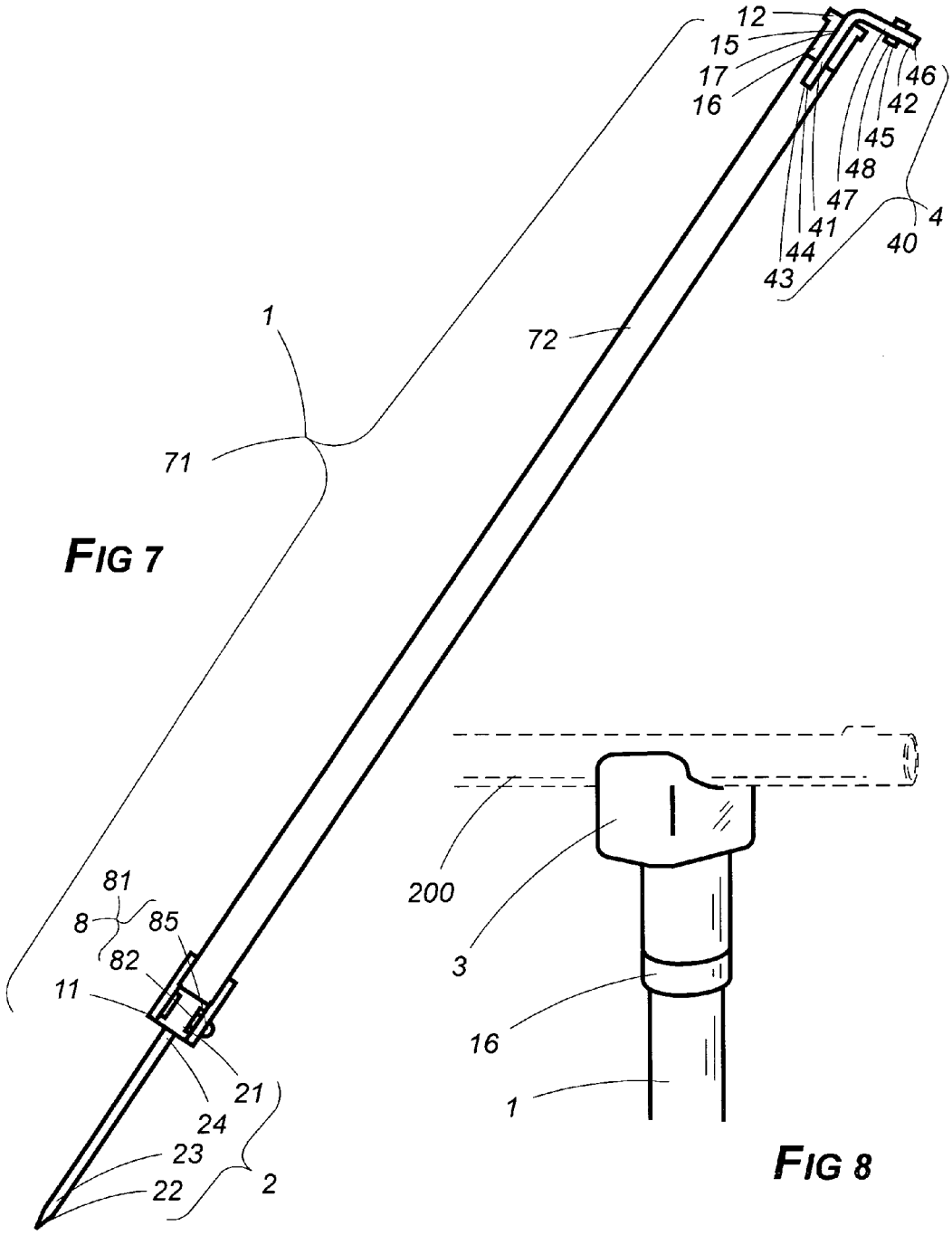
FIG. 7 represents the same version of the invention sans cradle (3) so that the seating site for the bow connection anchor's emplacement leg (41) is a tunnel (17) within the staff's bushing (16).
FIG. 8 illustrates the manner in which the cradle (3) supports a firearm (200) in gun hunting.
Figures 9, 10:
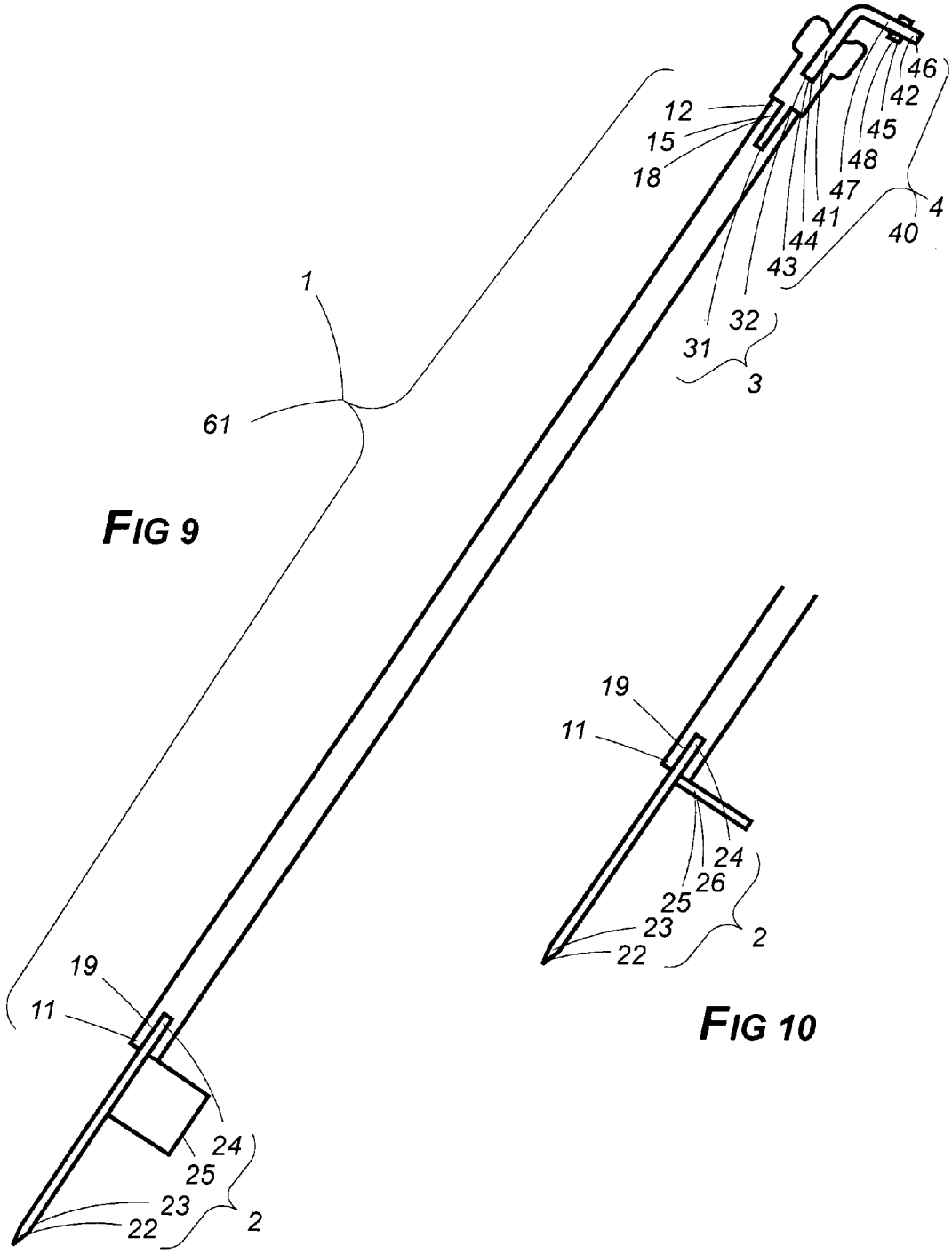
FIGS. 9 and 10 are longitudinal medial cross-sectional views of a solid staff (61), the former comprising a graphically disposed box representing variations for a foot thruster in a generic sense (25); the latter, a pegged foot one (26). In both illustrations, the spike (2), for which stowage arrangements are absent, is attached within a spike socket (19) formed within the staff's lower end (11).
Figures 11, 12, 13, 14, 15, 16:
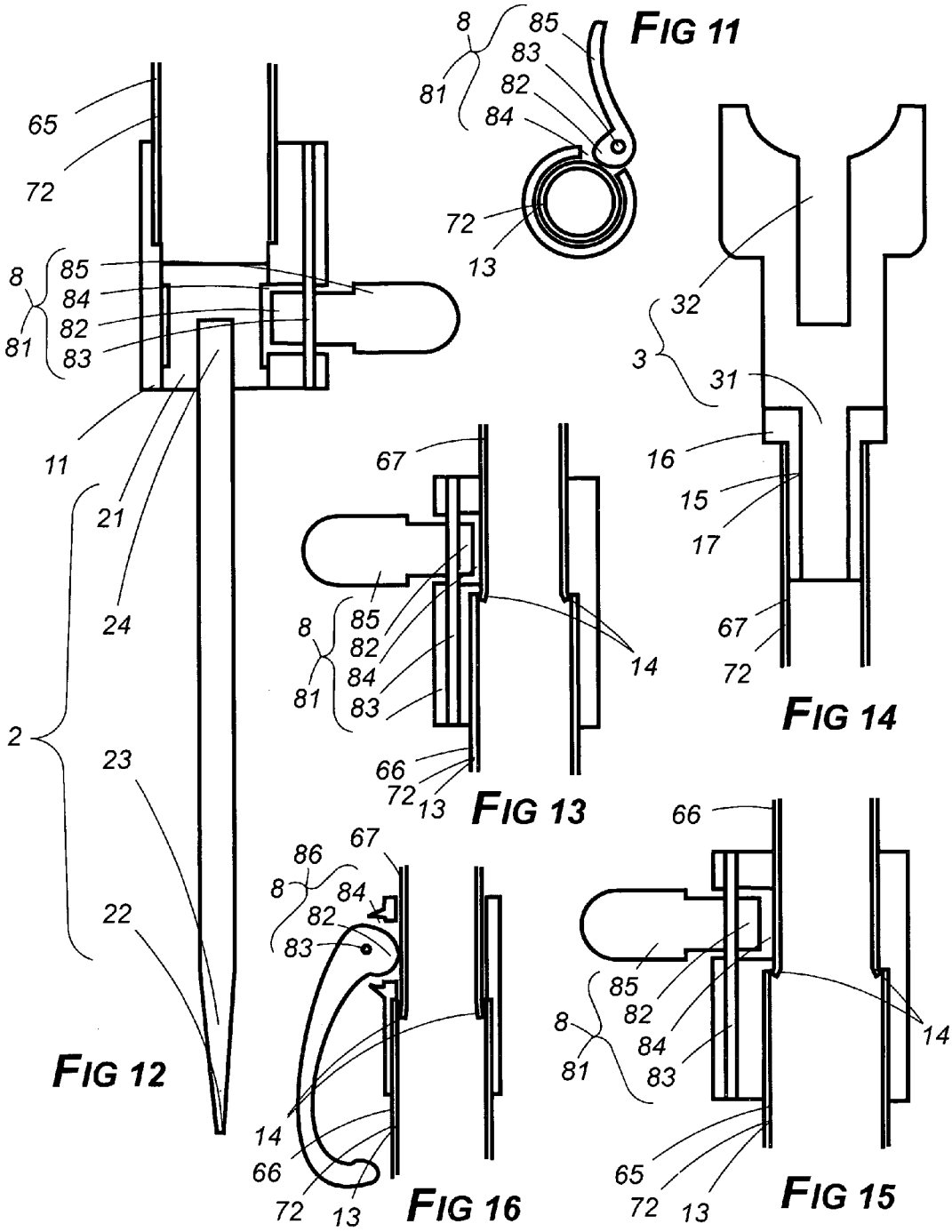
FIG. 11 depicts in single planular radial cross-section a cammed thumb lever clamp (81) as connecting means (8) between two sections of a segmented staff (13).
FIGS. 12-16 comprise longitudinal medial cross-sections of various portions of the assembly.
Figure 17:
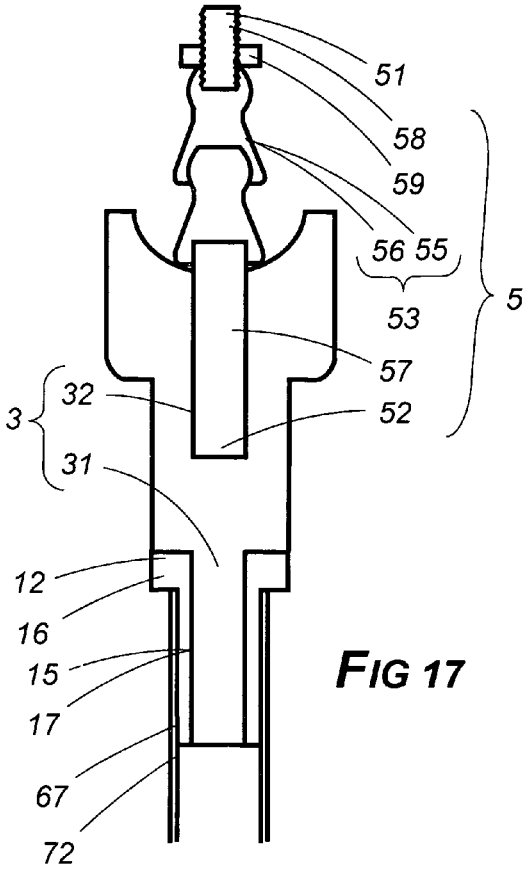
FIGS. 17 and 18 represent a suitable emplacement scheme for an accessory connection link (5) within the cradle's emplacement socket (32), the former in longitudinal medial cross-section.
Figure 18:
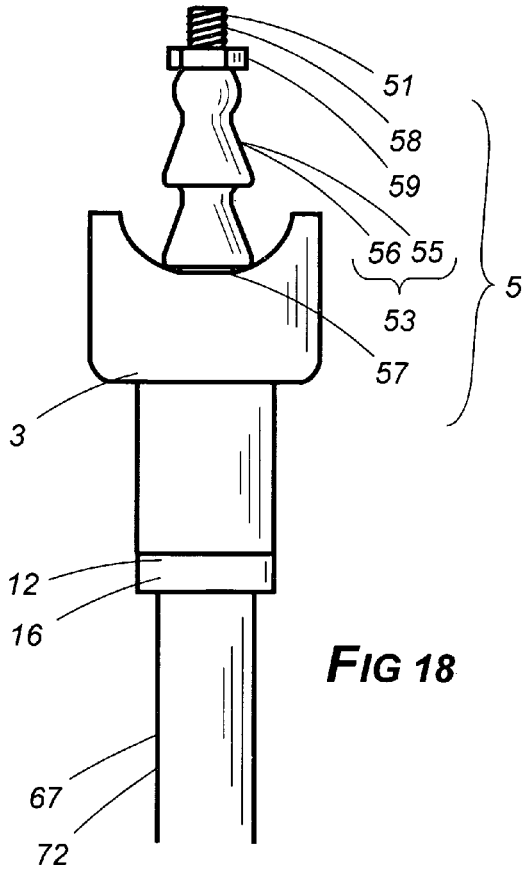
Figure 19:
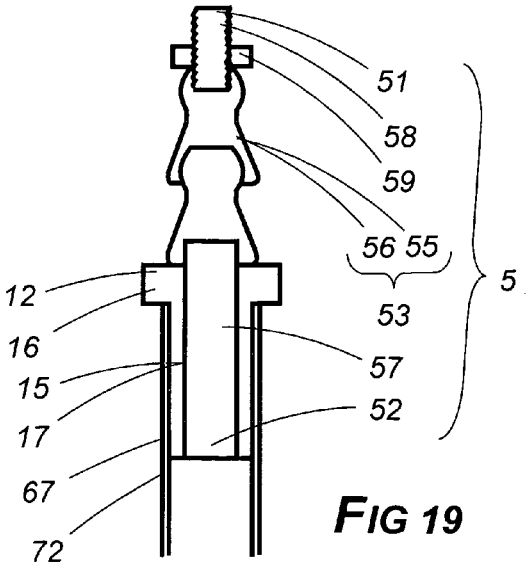
FIGS. 19 and 20 are similar illustrations wherein the accessory connection link's (5) emplacement is within the staff's bushing tunnel (17) altogether by-passing the use of the cradle (3).
Figure 20:
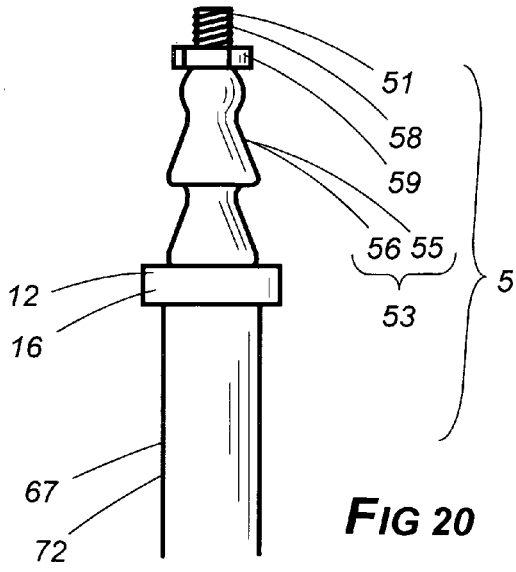
Figure 21:
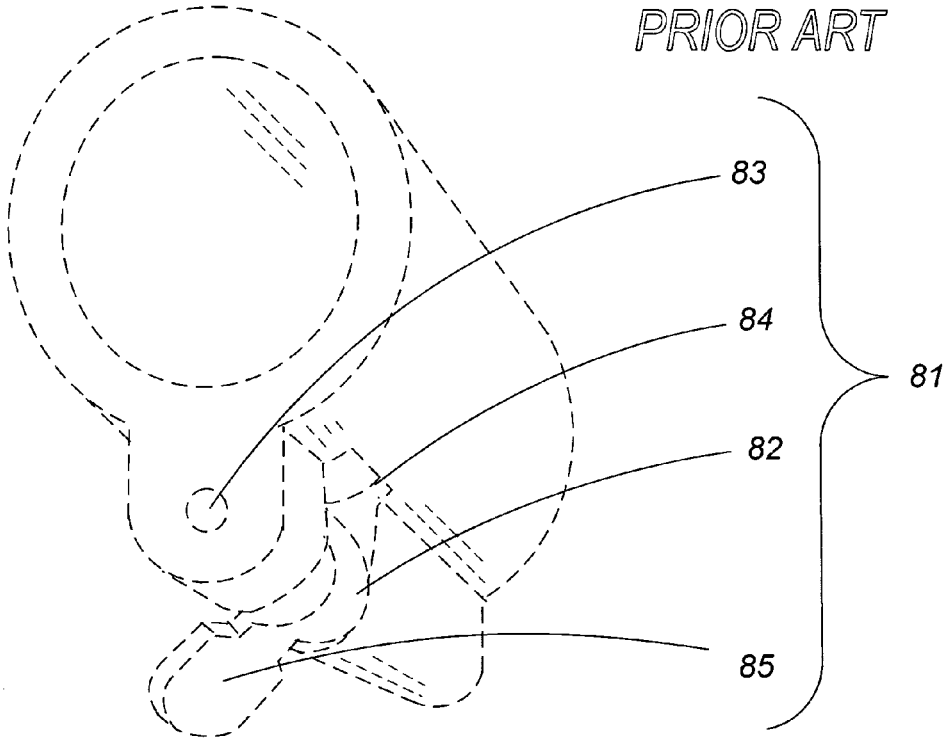
FIGS. 21 and 22 comprise renderings of prior art objects—in the former, a cammed thumb lever clamp (81) and in the latter, a drywall anchor (600) suitable for use as an accessory connection link's emplacement peg (57).
Figure 22:
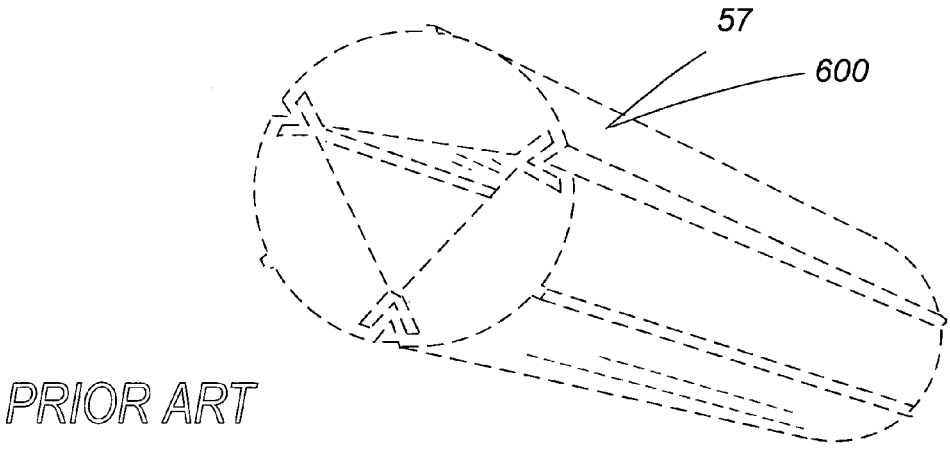
Figure 23:
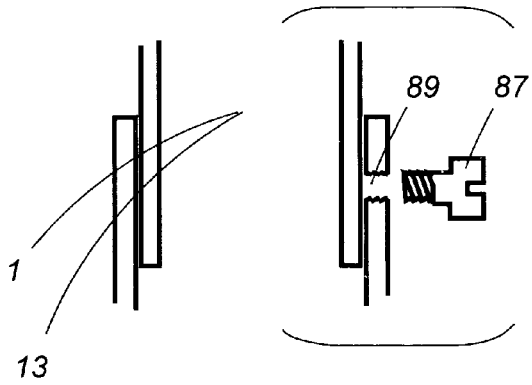
FIGS. 23 and 24 illustrate lesser preferred, supra, set screw or thumb screw clamping arrangements (87).
Figure 24:
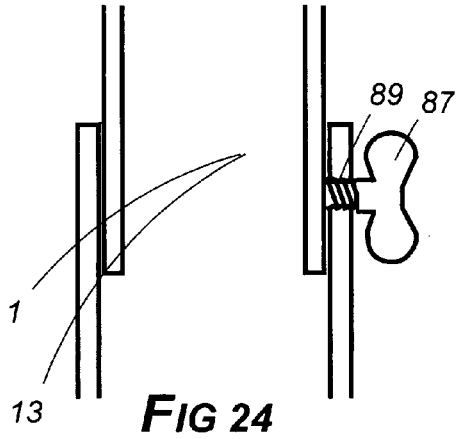
Figure 25:
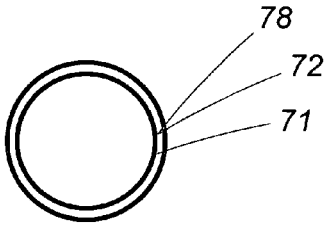
FIGS. 25-30 comprise a variety of feasible cross-sectional tube (71) shapes for the staff (1). They include round,—or cylindrical (72),—
Figure 26:
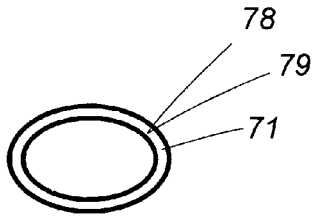
Figure 27:
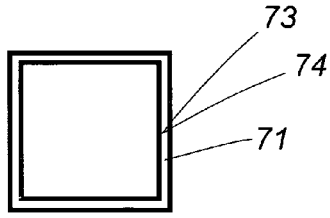
Figure 28:
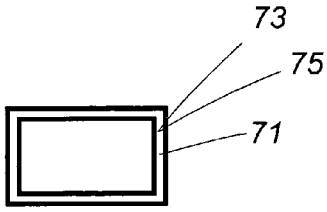
Figure 29:
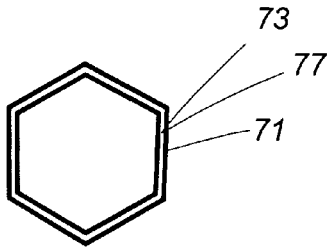
Figure 30:
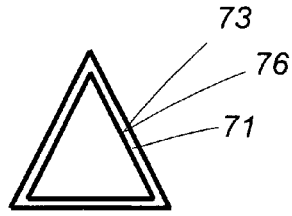
Figure 31:
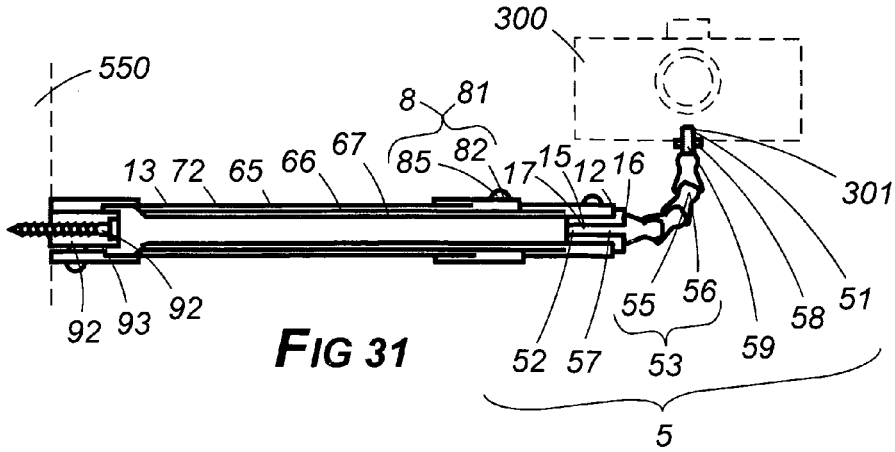
FIGS. 31-33 represent depictions of the collapsed assembly screwed horizontally (9) into a tree or similar structure (550) to posture a camera (300) supported via an accessory connection link (5).
Figure 32:
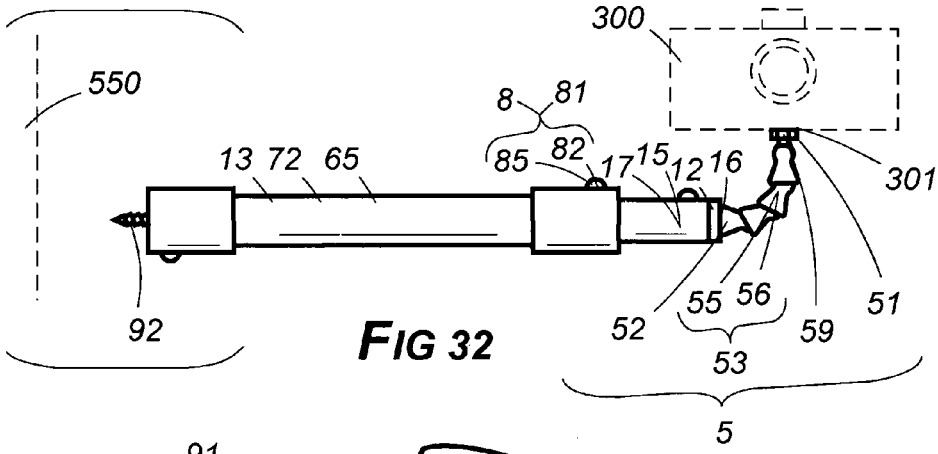
Figure 33:
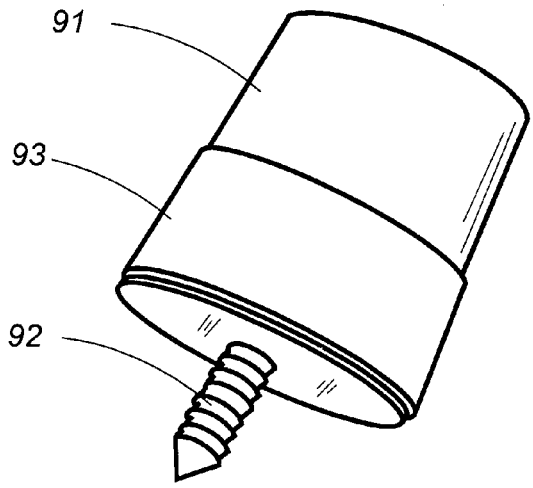
Figure 34:
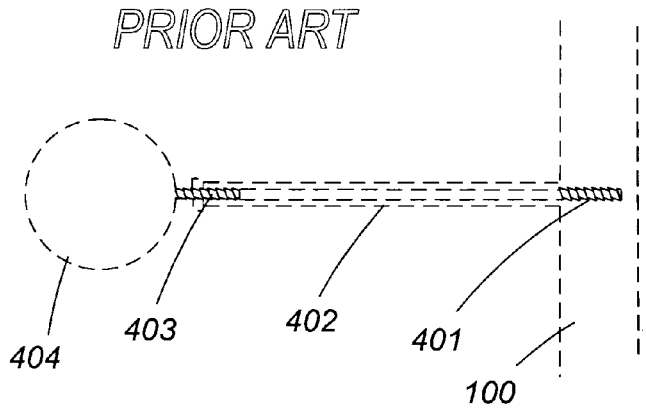
FIG. 34 comprises a prior art stabilizing rod (402) with a stabilizing counterweight (404), supra, screwed into the rod's threaded cavity (403).
Figure 35:
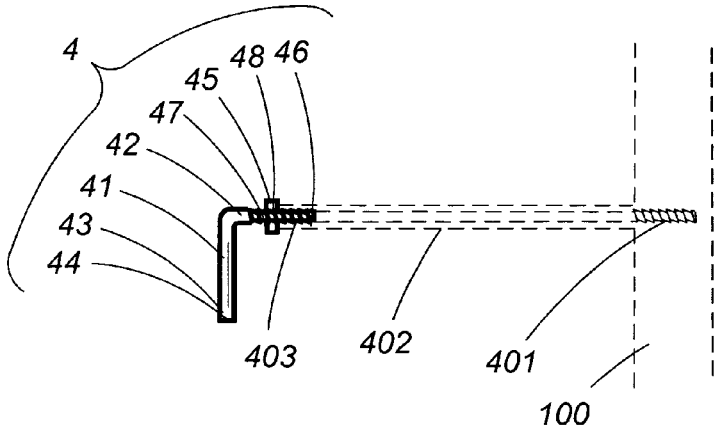
FIG. 35 illustrates the use of this stabilizing rod (402) in conjunction with the bow connection anchor (4), an option in appropriate circumstances hereinafter explained, ante.
Figure 36:
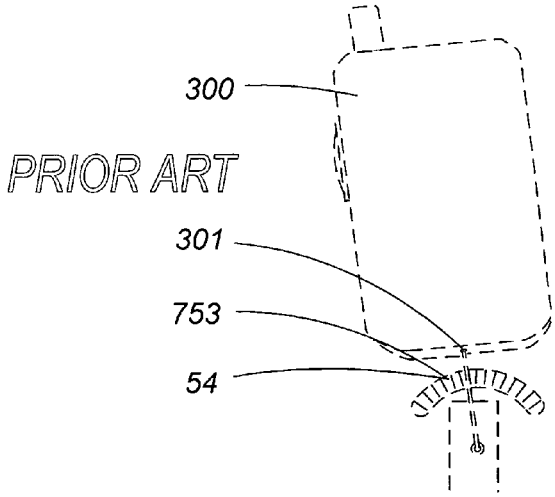
FIG. 36 represents a camera (300) supported by prior art pivotal plane support (54) comprising a protractor-like structure enabling fore and aft tilting capability.
Figure 37:
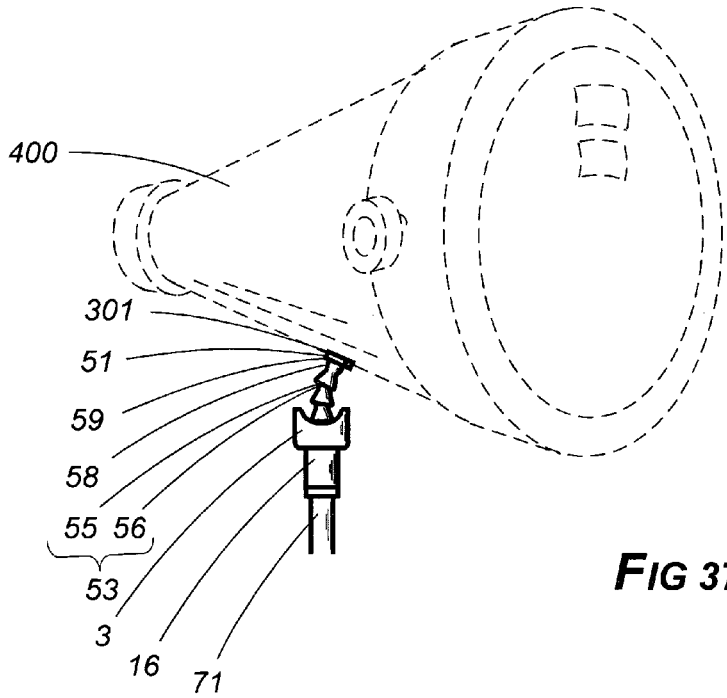
FIG. 37 comprises an arrangement in which a spotting scope (400) is connected to the accessory connecting link (5) by interthreading in the same manner a camera (300) would be.

The subject of this application is a hunting implement and accessories support comprising a staff (1)—which includes an important ground spike (2)—and a cradle (3) as some of its main components. The staff (1) and its spike (2) connect end-to-end to provide a relatively narrow elongated structure capable of anchoring into the ground (500) to fix it in place. One or another of alternative pieces comprise the remaining components including, in many set-ups, a cradle (3) and either a bow connection anchor (4)—that is, an anchor for a hunting bow (100)—or an accessory connection link (5) to support a camera (300) for picture taking, a spotting scope (400) to search telescopically for game and properly identify it or for use as any other suitable connective accessory.

The staff (1) may comprise traditional one-piece, or solid, structure (61) with the ground spike (2) attached to its lower end (11). In preferred embodiments of this familiar variation, the spike (2) comprises a foot thruster (25)—a substructure situated so that the operator's foot may push against it to more effectively jam the spike (2) into the ground (500). The cradle (3), supra, is disposed atop the staff (1) to provide a firearm rest. Well known as this elementary assemblage is in the art, its utility for bow (100) hunting is considerably enhanced by providing the cradle (3) rotability, supra, and configuring it to accommodate a bow connection anchor (4)—also preferably rotable—with receptive emplacement means (15) to that end. The cradle (3) further comprises an emplacement peg (31) disposed at its (3) underside for seating within a bushing (16) at the staff's upper end (12), ante.

Since hunting bows (100) are generally provided with an anchoring receptor (401), supra,—typically a threaded well or tunnel for interthreading—a preferable anchor (4) comprises an elbowed, or L-shaped, rod (40), one extension of which is designated its emplacement leg (41) and the opposing one, its bow anchoring end (42). The anchor (4) comprises bow anchoring means (45) at the latter leg's anchoring end (46), preferably a threaded sector (47) and a threaded nut (48) disposed to lock the interthreaded connection together. A suitable means of emplacement (43) is disposed at the anchor's (4) opposing extremity—its emplacement leg's seating end (44)—for connection to the staff's upper end (12), preferably, into an emplacement socket or tunnel (32) disposed within the cradle (3) if one (3) is included as part of the assembly; or if not, into a socket or tunnel (17) within the staff's bushing (16). A straight extension of the rod's emplacement leg (41) is the most acceptable emplacement means (43), since it permits axial swiveling for azimuth control within whatever socket (17, 18, 32) it is set into. In that respect, this leg (41) should not be permitted to fit too tightly but rather, narrow enough to be manipulated in that fashion.

When the cradle (3) is present as it (3) preferably is—some means for receptive emplacement (15) is required for its (3) connection to the staff (1). In a staff (1) of solid composition, this (15) is provided merely by drilling a peg socket (18) axially into the staff's upper end (12). A tubular staff (71), however, is by itself unsuited for that purpose and must, accordingly, be provided the mentioned bushing (16), supra, fitted to that end (12) as the emplacement means (15) and comprises the socket or tunnel (17) formed longitudinally within. It (16) is preferably configured so that a substantial part of it (16) fits snugly within a tubular staff (71) in the manner of a plug so that either the cradle's emplacement peg (31) or the bow connection anchor (4) may, indirectly speaking, be emplaced therein (71). Bushings (16) of this sort are readily available in the marketplace and configured in different sizes for installation within the ends of tubing (71) of various diameters. Of course, the tubular staff (71) may comprise a variety of cross sectional configurations (72, 74-77, 79). All defined as curvilinear (78), supra; or polygonal (73), supra; qualify as candidates with a consistently shaped bushing (16) provided as the emplacement means (15). Nonetheless, circular, or cylindrical, cross-sectional staff configuration (72) is by far the most readily available and economical, as are the bushings (16) used with it (72).

The cradle (3) and bushing (16) may be constructed as a one-piece subassembly. This may be accomplished either by attaching the two together or by milling them in what is characterized herein as unified configuration (36).

To address an important bow hunting need—that of azimuth control in readiness stowage, supra—the fit between the cradle emplacement peg (31) and the bushing tunnel or socket (17) should be just loose enough to provide the cradle (3) some rotability. Preferably, the dimensions of the peg (31) and tunnel (17) allow for this. The same is preferably true for the interconnection of the bow connection anchor (4) and staff (1) when no cradle (3) is present.

If the bow (100) is already equipped with one, a stabilizing rod (402) may be used in conjunction with the assembly which is the subject matter hereof in any instance in which additional connection clearance is desired. Once the stabilizing rod (402) is installed within the bow's anchoring well (401), supra, so that it (402) projects forward from the bow (100) with its own threaded cavity (403) in position for it, the assembly's bow extension leg (42) may in turn be interthreaded into it (403).

As observed among the objectives, supra, an assembly comprising collapsible sectional components (13) is far more preferable than a non-collapsible one, a solid model (61), for example. The most highly favored embodiment thereof comprises a cylindrical tubular staff (71, 72) sectionalized, or segmented (13), to provide a bottom segment (65), a mid-segment (66) and an upper segment (67). In keeping with the needs and objectives set forth herein, supra, the lower portions of the upper two segments (66-67) are appropriately flanged (14), and the segments (13) then interconnected by a cammed lever enwrapping clamp (81). The assembly is thereby made to comprise ultra-collapsibility.

In a traditional solid non-collapsible staff (61), the ground spike (2) is generally fixed in place within a spike socket (19) merely drilled into the lower end (11). Where the ground spike (2) is concerned, however, the collapsible arrangement (13) of an assembly of tubular construction (71) provides an even further opportunity for compactness. The spike (2) is preferably fashioned as a separate component comprising a collar (21) at its seating end (24)—that is, the end which connects to the staff's lower end (11). The collar (21) is factored to fit within an opening there (11), effectually characterizing it (2) an additional member of the take-apart, put-together assembly (13). Accordingly, the collar (21) is formed so that, like the segmented components (65-67), it (21) can be impinged upon by the same sectional connecting means (8), supra. Upon disassembly, the spike (2) may be turned around so that its penetration tip (22) is pointed upwards within the staff (1) and fully inserted so that the collar (21) is impinged just as when the spike (2) is assembled for use with its anchoring end (23) stuck into the ground (500), but now held firmly in place in reverse order with the spike (2) is oriented upwardly within the staff's lower end (11). Of course, this same impingement scheme for the stowed spike (2) is also feasible for a non-segmented staff of tubular configuration (71); but where compactness is at a premium, one must acknowledge segmentation (13) as the most preferable arrangement.

The most suitable configuration for the collar (21), then, is one which confers upon it (21) sufficient size to fill the cross-sectional opening of the staff's tubular configuration (71) and additionally, a sector of optimal diameter for impingement by the cammed clamp (81, 86). Experience demonstrates that for the preferred cylindrical tubular staff (71, 72), a semi-cylindrical or modified cylindrical configuration of I-shaped cross-section—similar in appearance, for example, to the wooden core of a spool of thread wherein the slightly larger end diameters exceed that of the mid-sector—is preferred. A suitable seat is thereby provided for clamp (81, 86) impingement. For constructions other than cylindrical (72), the same scheme may be employed allowing, of course, for the tube's particular cross-sectional shape (73, 78). While longitudinal symmetry in configuration is not essential, the configuration is such that the clamp's (81, 86) impingement is equally effective in either direction of the tip's (22) is orientation.

As mentioned, supra, one advantage of segmented construction (13) is its (13) capability for substitutive interchangeability of functional components. Thus, an accessory connection link (5) may be positioned atop the staff (1) in place of the bow connection anchor (4). For the assembly which is the subject hereof, any appropriately threaded piece may be intermediately emplaced so long as it comprises at its emplacement end (52) a peg (57) for insertion into a staff's upper end (12), a staff's bushing (16) at that site (12) or into a cradle socket (32) if a cradle (3) is present. Ideally, the intermediate link (5) comprises rotability and other angular adjustment capabilities (53). The market has provided an exceptionally useful article for just this purpose.

A series of hollowed objects approximately three-quarters inch high and shaped somewhat like a chess pawn have been snapped together end-to-end to create an articulated linkage (55) which may be rotated and bent into practically any linear configuration. For the support of a camera (300), spotting scope (400) or other accessory, many sorts of linkage (55) would suffice, so long as the joints between the individual links is relatively stiff—that is, comprising a state wherein the linkage (55) will retain the configuration into which it (55) is tilted or twisted. These useful linkages (55) have been employed in industry, sometimes with as many as three interconnected segments, to manipulate a jet of air or liquid coolant upon otherwise overheated cutting tools and are, therefore, readily available commercially. The joints of the assembly (55) are tight, comprising a ball and socket (56) series of rotable hinges which meets well the need for the high level of tilt and swivel variability required for photographic view posturing or telescopic observation, supra. It has been observed that even with no more than two of the links so interconnected, manipulation permits moving anything to which it (55, 56) is joined—a camera (300), spotting scope (400) or other suitable accessory—in the matter at hand—to any point within about a 30° vertical cone.

The accessory connection link (5) is completed by providing at its (5) underside an accessory support emplacement peg (57) and at its topside an accessory connecting end (51) a threaded accessory connecting sector (58) and accessory support locknut (59) to secure the accessory (300, 400) to it (5). Because an emplacement peg (57) does not come with the happily available commercial linkage (55), supra, it is necessary to provide one (57) for it (55). As it happens, a drywall anchor (600)—that is, an expansion plug configured to receive a screw driven into it (600) for retention within wallboard—is an additional readily available commercial article in a size which may be forced into the hollow of the bottom link in the linkage assembly (55) to effect an acceptable connection to the staff (1), its bushing (16) or within a cradle (3), if present. More preferably, of course, the accessory connection link (5) is fabricated in its (5) entirety at the manufacturing level so as to comprise the emplacement peg (57) as a unified part thereof (55).

The cradle (3) meets the long-enduring objective, supra, of providing also a firearm (200) support while awaiting the approach of game. It (3) is concavely shaped across its (3) top to allow the firearm's (200) barrel to rest there.

The compacted staff (1) may be dedicated to an alternative use in that it may be configured for horizontally attachment (9) to a tree or other vertical supporting structure (550). For this, an anchoring dowel (91) of thickness permitting insertion into the bottom segment (65) is provided. A threaded pointed rod (92)—preferably a lag bolt because of it ready availability—is driven longitudinally through it (92), preferably comprising axial disposition therein (92), so that its (92) pointed end sticks out enough to be threaded into the tree or other structure (550) for dependable anchoring. In use, the compacted staff (1) is twisted, or turned, by hand in driving the rod or lag bolt (92) in. To insure that the dowel (91) and bolt (92) respond to the crank-like turning of the staff (1), it is advisable to coat the dowel (91) with a gripping pad (93)—preferably tape—to provide the required turning friction. Thus fixed in place, the assembly may now be employed in conjunction with the accessory connection link (5) for picture taking. Moreover, should the underlying terrain (500) be such that a ground spike (2) cannot be pushed into it (500), this horizontally (9) disposed arrangement provides—for the bow (100) of the lighter traditional variety (100) comprising a receptor anchoring well (401)—an alternative to the otherwise vertically disposed bow (100) support.

The entire assembly in its most preferable aspects may be summarized to comprise a kit. It would, thus, be appropriate to state that it comprise a plurality of interconnective tubular (71) staff segments (13), configured in progressive rod and sleeve fashion wherein the segments (13) may be co-axially collapsed within one another (13), narrowest to widest, the lowest comprising the widest, or may conversely be co-axially extended from within one another (13), widest to narrowest, each of two conjoining segments (13) being interconnected by a cammed thumb lever (85) enwrapping clamp (81) wherein the upper portion of (81) enwraps the lower end of an upper conjoining segment (13) and the lower portion of each (81) enwraps the upper end of the lower segment (13); and to add that the clamp (81) comprise an interior stop configured to impede or restrict the upward advance of the lower of two conjoining segments (13); and that the lower connective end of each conjoining segment (13) comprise a flanged (14) rim such that the lower connective segment (13) is prevented by reason of the interior stop from sliding upwards or outwards of the segment (13) with which it (13) is conjoined.

And it would be appropriate to insist that the kit further comprise a ground spike (2) having an anchoring end (23) configured for thrusting into the underlying terrain and a seating end (24) shaped to fit within the lower end of the lowest staff segment (65) and disposed in either longitudinal direction and connected thereto by means of a cammed thumb lever (85) enwrapping clamp (81).

It might then be added that the staff's uppermost segment (67) comprise in the upper end thereof (67) a bushing (16) comprising a cradle peg emplacement socket (17); and that there further be present a cradle (3) with a downwardly disposed emplacement peg (31) and an upwardly oppositely disposed peg socket (32) therein. It should also be stated that the emplacement peg (31) be configured for rotable seating therein (32).

The kit would further be stated to comprise a bow connection anchor (4) comprised of an elbowed rod (40) in turn having a cradle emplacement leg (41) and a transversely disposed bow anchoring leg (42) configured for connection to a bow (100).

The kit would provide also for camera (300), spotting scope (400) and other suitable accessory use by stating that it comprise an accessory connection link (5) having a downwardly disposed emplacement peg (57) configured for seating within the cradle's peg socket (32), articulated ball and socket linkage (56) between the cradle (3) and the camera (300), spotting scope (400) or other suitable accessory and an upper terminal configured for threaded attachment to it (300, 400).

The inventor hereby claims:

1. A hunting implement and accessories support comprising:

an elongated staff comprising an upper end and an opposing lower end;

a ground spike comprising an anchoring end and a seating end wherein the seating end is disposed by connection to the staff's lower end;

the staff in turn comprising:

tubular configuration; and receptive emplacement means in turn comprising a bushing comprising one of a tunnel and a socket;

the assembly further comprising a bow connection anchor configured as an elbowed rod comprising an emplacement leg and a transversely disposed bow anchoring leg;

the emplacement leg configured for rotable seating within the staff's receptive emplacement means;

whereby upon thrusting the ground spike into the underlying terrain, the assembly may be conveniently employed for hunting as a bow readiness stowage support;

the assembly further comprising an accessories connection link comprising a downwardly disposed emplacement peg; and an upper terminal configured for threaded attachment to a camera, spotting scope or other suitable accessory;

wherein the link's emplacement peg is configured for seating within one of:

the staff's receptive emplacement means; and a cradle socket;

whereby upon thrusting the ground spike into the underlying terrain, the assembly may be alternatively employed for photographing as a camera support, telescopic viewing as a spotting scope support or for use as any other suitable accessory.

2. The hunting implement and accessories support according to claim 1 wherein the assembly further comprises a cradle comprising a downwardly disposed emplacement peg configured for rotable seating within the staff's receptive emplacement means; and a cradle socket disposed above and opposite its emplacement peg comprising size to accommodate rotable seating therein by the bow connection anchor's emplacement leg;

whereby upon thrusting the ground spike into the underlying terrain, the assembly may be alternatively employed for hunting as a firearm support.

3. The hunting implement and accessories support according to claim 2 wherein the cradle and bushing are of unified configuration.

4. The hunting implement and accessories support according to claim 2 wherein the staff comprises a plurality of interconnected segmented components configured to comprise the assembly with ultra-collapsibility.

5. The hunting implement and accessories support according to claim 4 wherein the means of interconnection between the staff's segmented components comprises cammed lever enwrapping clamps.

6. The hunting implement and accessories support according to claim 5 wherein the lower end of the elongated staff and the seating end of the ground spike are mutually configured so that the staff's lower end overlies the ground spike's seating end in sleeve fashion and is connected thereto by means of the cammed lever enwrapping clamps;

wherein upon the ground spike's release and removal therefrom for stowage, it is inserted reversibly inserted within the staff's lower end and retained therein by the enwrapping clamps.

7. The hunting implement and accessories support according to claim 5 wherein the cammed lever enwrapping clamps comprise thumb lever configuration.

8. The hunting implement and accessories support according to claim 4 wherein the means of interconnection between the staff's segmented components comprises one of threaded set screw and apertured connective components; and spring loaded snap-fit and apertured connective components.

9. The hunting implement and accessories support according to claim 1 wherein the accessories connection link comprises adjustment articulation.

10. The hunting implement and accessories support according to claim 9 wherein the adjustment articulation of the accessories connection link comprises one or more ball and socket joints.

11. The hunting implement and accessories support according to claim 1 wherein the assembly comprises an anchoring dowel configured with thickness permitting insertion into the staff's bottom segment;

a threaded pointed rod longitudinally disposed within the anchoring dowel such that the rod's point sticks out sufficiently to be threaded into a tree or other vertical supporting structure for dependable anchoring for one of a bow connection anchor for a traditional bow comprising a receptor anchoring well; and an accessory support.

12. The hunting implement and accessories support according to claim 11 wherein the anchoring dowel further comprises a gripping pad disposed by enwrapment thereon;

wherein the dowel's connection with the tree or other structure is facilitated.

13. A hunting implement and accessories support kit comprising:

a plurality of interconnective tubular staff segments, configured in progressive rod and sleeve fashion wherein the segments may be co-axially collapsed within one another, narrowest to widest, the lowest comprising the widest, or may conversely be co-axially extended from within one another, widest to narrowest, each of two conjoining segments being interconnected by a cammed thumb lever enwrapping clamp wherein the upper portion of each cammed clamp enwraps the lower end of an upper conjoining segment and the lower portion of each cammed clamp enwraps the upper end of the lower thereof; the clamp comprising an interior stop configured to prevent the upward advance of the lower of two conjoining segments; the lower connective end of each conjoining segment comprising a flanged rim such that the lower connective segment is impeded or restricted by reason of the interior stop from sliding upwards and out of the segment with which it is conjoined;

the kit further comprising a ground spike comprising an anchoring end configured for thrusting into the underlying terrain and a seating end configured to fit within the lower end of the lowest staff segment and disposed in either longitudinal direction and connected thereto by means of a cammed thumb lever enwrapping clamp;

the staff's uppermost segment comprising a bushing disposed in the upper end thereof, the bushing in turn comprising a cradle peg emplacement socket; the kit further comprising a cradle in turn comprising a downwardly disposed emplacement peg and an upwardly oppositely disposed peg socket therein, the emplacement peg configured for rotable seating within the staff's peg emplacement socket;

the kit further comprising a bow connection anchor; and an accessories connection link;

the bow connection anchor comprising an elbowed rod in turn comprising a cradle emplacement leg and a transversely disposed bow anchoring leg configured for connection to a bow;

the accessory connection link comprising a downwardly disposed emplacement peg configured for seating within the cradle's peg socket, articulated ball and socket linkage between the cradle and a camera, spotting scope or other suitable accessory and an upper terminal configured for threaded attachment to the accessory;

whereby upon thrusting the ground spike into the underlying terrain, the assembly may be conveniently employed for hunting as a bow readiness stowage support by interconnective inclusion of the cradle and the bow connection anchor; for photographing as a camera support, telescopic observation as a spotting scope or use by some other suitable accessory, by interconnective inclusion of the cradle and the accessory connection link; or for gun-type hunting as a firearm rest by interconnective inclusion merely of the cradle without the bow connection anchor or accessory connection link.

* * * * *